US005734209A

United States Patent [19]

Hallidy

[11] Patent Number: 5,734,209

[45] Date of Patent: Mar. 31, 1998

[54] LINEAR ELECTRIC MOTOR AND METHOD OF USING AND CONSTRUCTING SAME

[75] Inventor: William M. Hallidy, Glendora, Calif.

[73] Assignee: Uniflo Oilcorp, Ltd., La Mesa, Calif.

[21] Appl. No.: 211,016

[22] PCT Filed: Sep. 15, 1992

[86] PCT No.: PCT/US92/07779

§ 371 Date: Oct. 17, 1994

§ 102(e) Date: Oct. 17, 1994

[87] PCT Pub. No.: WO93/06369

PCT Pub. Date: Apr. 1, 1993

Related U.S. Application Data

[63] Continuation of Ser. No. 760,748, Sep. 16, 1991, Pat. No. 5,252,043, which is a continuation-in-part of Ser. No. 751,977, Aug. 29, 1991, Pat. No. 5,179,306, which is a continuation-in-part of Ser. No. 611,186, Nov. 9, 1990, Pat. No. 5,193,985, which is a division of Ser. No. 462,833, Jan. 10, 1990, Pat. No. 5,049,046.

[51] Int. Cl.[6] ..... H02K 41/02

[52] U.S. Cl. ..... 310/12; 310/14

[58] Field of Search ..... 310/12, 13, 14; 417/415, 416, 417

[56] References Cited

U.S. PATENT DOCUMENTS

| | | | |
|---|---|---|---|
| 4,687,054 | 8/1987 | Russell et al. | 417/417 |
| 4,815,949 | 3/1989 | Rabson | 310/14 |
| 4,965,864 | 10/1990 | Roth et al. | 310/12 |
| 5,049,046 | 9/1991 | Escue et al. | 417/411 |
| 5,179,306 | 1/1993 | Naser | 310/14 |

FOREIGN PATENT DOCUMENTS

| | | | |
|---|---|---|---|
| 975836 | 10/1975 | Canada | 310/12 |
| 748705 | 7/1980 | U.S.S.R. | 310/12 |
| 892595 | 12/1981 | U.S.S.R. | 310/12 |
| 1603495 | 10/1990 | U.S.S.R. | 310/12 |

*Primary Examiner*—Clayton E. LaBalle

*Attorney, Agent, or Firm*—Bernard L. Kleinke; Peter P. Scott

[57] ABSTRACT

A small diameter linear motor is relatively short in length, and includes a hollow elongated mover, and a stator having a plurality of annular spaced apart stator teeth. Individual electrical coils are wound from individual uninterrupted single wires extending from outside of the assembly in the spaces between the teeth to avoid the need for electrical connections between the coils. The stator assembly and mover are dimensioned to fit within the hollow interior of a ferromagnetic tube. In another form, the linear motor includes a mover and a stator, the stator including a set of coils for producing a series of electromagnetic fields extending at least partially in an axial direction when energized with an electric current and a stator core defining a plurality of spaced-apart transversely disposed coil receiving slots and an annular axially extending mover receiving bore. The mover includes an elongated member mounted telescopically and reciprocatively within the mover receiving bore and a plurality of permanent magnets interleaved with low reluctance spacers for helping to reduce core flux density in order to improve overall motor performance. The assembly further includes a cartridge unit with a linear motor attached threadably between a discharge housing assembly adapted to be secured removably to a cable for hoisting the cartridge unit through the production tubing of a well and a suction housing assembly for facilitating the pumping of well fluids from a downhole well. The linear motor includes a mover adapted to engage threadably a stop valve for permitting one-way flow of fluid through the mover and into the discharge housing for discharge into the production tubing. For increased pumping efficiency, the suction housing and check valve are replaceable with a lifting pump and piston respectively. Thus, the assembly is usable in both shallow and deep wells.

23 Claims, 28 Drawing Sheets

LINEAR ELECTRIC MOTOR AND METHOD OF USING AND CONSTRUCTING SAME

CROSS-REFERENCE TO RELATED APPLICATIONS

This application is a continuation of prior U.S.patent application Ser. No. 07/760,748, filed Sep. 16, 1991, now U.S. Pat. No. 5,252,043, which is a continuation in part of U.S. patent application Ser. No. 07/751,977, filed Aug. 29, 1991, now U.S. Pat. No. 5,179,306, which is a continuation in part of U.S. application Ser. No. 07/611,186, filed Nov. 9, 1990, now U.S. Pat. No. 5,193,985, which is a division of U.S. patent application Ser. No. 07/462,833, filed Jan. 10, 1990, now U.S. Pat. No. 5,049,046.

This application relates to U.S. patent application Ser. No. 07/462,833 filed Jan. 10, 1990 entitled "PUMP CONTROL SYSTEM FOR A DOWNHOLE MOTOR-PUMP ASSEMBLY AND METHOD OF USING SAME," now U.S. Pat. No. 5,049,046. Said above-referenced application is assigned to a common assignee and is incorporated herein by reference.

TECHNICAL FIELD

This invention relates to linear electric motors, and more specifically to the making and using of a small diameter tubular linear electric motor with a pump assembly for removing fluids from a well.

BACKGROUND ART

With the advent of the industrial age and the need for inexpensive and readily available fuels, there has been an ever increasing demand upon the oil reservoirs of the world. Such demand has depleted the more easily accessed oil reservoirs and created a need for more cost-effective and efficient methods of recovering well fluids from low production wells.

Accordingly, several potential solutions have been proposed for not only reducing the cost for manufacturing and installing downhole fluid removing equipment, but also for reducing the daily operating cost and maintenance cost of such equipment once installed.

One attempt at improving the cost effectiveness of recovering fluids from low production wells was the utilization of a downhole motor-pump assembly employing a linear motor coupled to a ground surface power source and motor controller by an electrical conduit. While such a solution was satisfactory for some applications, such an arrangement proved to be too expensive in installing and removing such assemblies for repair purposes as the depth of modern wells was extended.

Another attempt at improving cost and efficiency factors in low production wells is disclosed in U.S. Pat. No. 5,049,046. In that application, there is disclosed, a downhole motor-pump assembly suspended by a cable for coupling power and control signals downhole and for introducing and removing a motor-pump assembly from the well via the production tubing of the well. Such a motor-pump assembly is a highly desirable approach for many low producing wells. While such an assembly and system is desirable it would be highly desirable to have a pump and motor assembly which is easier to transport and to install. In this regard, because of the physical constraints of requiring the motor-pump assembly to be mounted within a production tube having a very small diameter such as approximately two inches, it has proven difficult, if not impossible, to substantially decrease the overall length of such a motor pump assembly while still maintaining its efficiency and thrust or drive producing forces.

For example, while it may be theoretically possible to have a small diameter linear motor that produces a certain drive force, such as a 500 lb. thrust, such a motor would be so long (in excess of 50 feet in length) that it would be unwieldy due to its excessive length. In this regard, such a motor could not be easily and readily transported from a manufacturing site to a well site by conventional and relatively inexpensive transportation. Moreover, because of its unwieldy length the motor-pump assembly would be difficult to mount in the production tube at the well site.

Therefore it would be highly desirable to have a new and improved linear motor which would produce a sufficient amount of thrust to efficiently remove well fluid from a deep well in a cost efficient manner and which could be easily and installed at transported by conventional transportation a well site in a relatively inexpensive manner.

There have been many different types and kinds of motor and pump assemblies for removing well fluids from a well. For example reference may be made to the following U.S. Pat. Nos. 4,350,478; 4,477,235; 4,687,054; and 4,815,949. Each one of the above mentioned patent describes a motor for use with a pump for fluid pumping purposes. While such combinations are generally desirable in many applications, the use of such electromechanical devices necessitate periodic replacement. In this regard, conventional replacement techniques have required that well production tubing generally attached to such motor-pump assemblies, be removed from the well in order to replace the motor-pump assembly. Following such repair or replacement, the entire structure of the production tubing and the motor-pump assembly must then be reinstalled in the well. Such repair and replacement procedures are both time consuming and expensive.

Because of the above mentioned problems, several attempts have been made to improve such procedures. In this regard, U.S. Pat. No. 4,350,478 mentioned above describes an improved procedure where a motor-pump assembly is supported from below by a seat attached to the end of the production tubing, thus enabling the assembly to be extracted from the well by raising (and lowering) the assembly within the production tubing of the well. While this method of removing and replacing the motor-pump assembly from a well is desirable, such an assembly would be so unwieldy in length that it would be difficult, if not impossible to transport and install such an assembly using conventional transportation and installation equipment.

Another attempt at solving such problems is disclosed in U.S. Pat. No. 5,049,046. The motor-pump assembly disclosed in this patent has a significantly larger transverse to axial length ratio thus, the disclosed assembly may be readily transported and installed with conventional equipment. As noted in this application however, significant design tradeoffs are involved in developing a motor with sufficient thrust to efficiently and effectively drive a pump for removing fluids from a well.

For example, it is well known that in order for a piston to push liquid out of a cylinder, such as the production tubing of a well, it must operate against the hydrostatic pressure of the fluid within that cylinder. In this regard, the hydrostatic pressure of raising fluids from a shallow well of 300 feet compared to a deep well of 5000 feet for example, are significantly different. Thus, although a given motor-pump assembly may be completely satisfactory for operation in a shallow well, such a given assembly, unless designed for deep well operation, would be completely unacceptable in a deep well.

Therefore, it would be highly desirable to have a new and improved motor-pump assembly that would be universally adaptable for use in both shallow and deep wells.

In electric motors, the force that causes motor action is developed by the interaction between lines of magnetic flux and the electric current in wires or electric conductors in the zone including the air gap between the moving and stationary parts of the motor. In this regard, one of the primary objects in the design of an electric motor is ordinarily to maximize the number of lines of magnetic flux interacting with the current conducting wires of the motor.

Thus, in order to develop a useful amount of force by the motor, substantially all of the path of the magnetic flux, except for the required small air gap between stationary and moving parts, be made of ferromagnetic material, such as iron to maximize or at least increase greatly, the number of magnetic flux lines interacting with the electric current. Additionally, the cross-sectional area of the iron path must be sufficient to carry substantially all of the magnetic flux.

The iron or other ferromagnetic material forming the path of the lines of magnetic flux, must form a closed loop or continuous path surrounding the current carrying wires. The portion of the magnetic flux path extending along the outside of the motor stator from one magnetic pole to the adjacent magnetic poles, is referred to as the stator yoke or stator back-iron. The portion of the magnetic flux path extending between adjacent magnetic poles at the inside of the rotor or mover, is referred to as the rotor or mover core.

Substantially all of the mechanical force developed in an electric motor is generated in the zone including the air gap. The amount of mechanical force developed by a given amount of electric current is a function of the dimensions of the zone including the conductors and the air gap. This function is expressed as a function of the $D^2L$ of the air gap area, where D is the diameter of the air gap zone and L is the axial length of the air gap zone.

In electric motors, the diameter D is made as large as the restraints of the application permits, to minimize, or at least reduce greatly, the axial length of the motor. In rotary motion motors, the restraining factor is usually the centrifugal forces on the rotating member of the motor. In some cases, the restraining factor is the geometry of the space into which the motor must fit.

In the case of tubular linear electric motors designed to fit inside structures such as steel production tubing used in downhole wells, such as oil, gas or water wells or such other applications, the internal diameter of the steel tubing of the well is the restraining factor limiting the diameter D of the air gap zone of the motor. The outside diameter of the stator yoke must be sufficiently small to fit inside the steel tubing of the oil well or similar application.

In applications involving small diameter tubing in downhole wells or other applications where a small diameter linear motor is required, the necessarily smaller yoke dimension means that the critical D dimension of the air gap zone will be much smaller than desired. Thus, in many of these applications, a small tubular linear electric motor provides a practical means for pumping liquids or other material. However, for the purpose of developing sufficient thrust or force to raise a sufficient amount of fluid to the surface, such a small diameter linear motor is extremely long in its axial length. For example, depending on the requirements of a given well, the linear motor may be about two inches in diameter to fit into the production tubing of the well, and may be about 30 to 50 feet in length.

Such a long, slender motor is very difficult, if not impractical to construct. Also, it is difficult to store, and to be transported to the well site. Installation of such a motor can be awkward, due to the handling requirements.

Therefore, it would be highly desirable to have a new and improved tubular linear motor with a relatively shorter axial length that develops sufficient axial forces for downhole pumping or other uses.

Another problem associated with downhole tubular linear motors is the difficulty in assembling its electrical windings in its outer stationary member. In this regard, the usual practice or procedure has heretofore been to wind a multiplicity of individual coils of electric wires, and to assemble such coils interspersed with a multiplicity of annular rings composed of iron or other ferromagnetic material. The individual coils are then connected electrically to each other by soldered or welded connections to form three phase windings for conventional linear motor operation. Such connections are undesirable, because they are subject to early failure, particularly in extensive downhole well applications.

For example, a prior known 18-pole three-phase tubular linear electric motor containing 54 coils required 108 individual soldered internal connections, in addition to four external connections. The reliability of such a motor, with so many critical connections made under difficult assembly conditions, is such that the motor is subject to malfunction, should one or more of the connections break. Also, repairs would be difficult to make. Also, the assembly operations are awkward, tedious and costly. Highly trained personnel are required for such operations.

Therefore, it would be highly desirable to have a new and improved tubular linear motor, which is highly reliable, relatively easy to assemble, and less prone to malfunctioning, even in demanding downhole well applications.

Still another problem in conventional tubular linear motors is that the coils of current carrying wires, surrounded by the ferromagnetic material forming the magnetic path, are usually isolated, and thus subject to unwanted heat build up, caused by the current flow in the windings. In this regard, the heat generated in the windings builds up, due to the substantial thickness of the flux carrying stator yoke. The thermal resistance of the heat flow path, coupled with the maximum allowable operating temperature of the current carrying wires, limits the amount of electric current that the wires of the windings can safely carry before overheating.

Therefore, it would be highly desirable to have such a new and improved tubular linear motor which is so constructed as to reduce greatly unwanted heat build up.

DISCLOSURE OF THE INVENTION

Therefore, the principal object of the present invention is to provide a new and improved tubular linear motor wherein the axial length of the motor is relatively shorter and the diameter is relatively small, for a given thrust.

Another object of the present invention is to provide such a new and improved tubular linear motor, which is highly reliable, and relatively inexpensive and easy to manufacture.

A further object of the present invention is to provide such a new and improved tubular linear motor, which is so constructed as to reduce greatly thermal heat build up.

Another object of the present invention to provide a new and improved linear motor and method that helps reduce losses in order to improve the overall efficiency of the motor for removing well fluids from a deep well in a cost efficient manner.

A further object of the present invention is to provide such a new and improved linear motor that can be easily transported by conventional transportation and installed at a well site in a relatively inexpensive manner.

Still yet another object of the present invention is to provide a new and improved control system for use with the linear motor and a method of using the same for producing a highly efficient reciprocating action for well fluid pumping purposes.

Another object of the present invention to provide a new and improved linear motor-pump assembly which is highly efficient and readily useable in both shallow and deep wells.

A further object of the present invention is to provide such a new and improved linear motor-pump assembly and method of using it so that it can be coupled to a conventional pump to provide additional pumping capabilities.

The above and further objects of the present invention are also realized by providing a new and improved tubular linear motor for many applications including downhole well use and other applications, wherein the small diameter motor is relatively short in length, can be conveniently assembled, and highly reliable in operation.

A small diameter tubular linear motor is relatively short in length, and includes a hollow elongated mover having a traverse mover area $A_M$, and a stator having a plurality of annular spaced apart stator teeth each having a stator tooth area $A_S$. Individual electrical coils are wound from individual uninterrupted single wires extending from outside of the assembly in the spaces between the teeth to avoid the need for electrical connections between the coils. The stator assembly and mover are dimensioned to fit within the hollow interior of a ferromagnetic tube having an annular transverse cross sectional area $A_T$ and having a dimensional relationship where the ratio of the stator tooth area $A_S$ to the transverse tube area $A_T$ of the hollow tube is equal to between about 0.1 and about 1.25, and where the ratio of the stator tooth area $A_S$ to the mover area $A_M$ is equal to between about 0.1 and about 1.25, to have sufficient magnetic flux linkage with the tube to develop high thrust for the mover for a relatively short motor size, with reduced heat loss.

The above and further objects of the present invention are further realized by providing a new and improved linear motor and method of using it with a control system for downhole use, for producing a sufficient reciprocating thrusting action to let well fluids be pumped through the production tubing of the well to the ground surface. The linear motor includes a laminated stator having a very small transverse thickness to axial length ratio. The stator includes an annularly-shaped hollow core defining a plurality of transversely extending spaced-apart coil receiving slot and a set of coils individually mounted in said slots for producing a series of electromagnetic fields extending at least partially in an axial direction when energized electrically. The linear motor also includes an elongated rod with a series of permanent magnets interleaved with low reluctance spacers mounted thereon for helping to reduce core flux density in order to improve overall motor performance.

The system includes a surface motor control unit and a motor-pump cartridge unit having the motor, a downhole motor control unit, that cooperates with the surface motor control unit to supply electrical pulses to the motor, and a downhole pump unit coupled to the motor for pumping fluids from a well. The cartridge unit is supported in a downhole cartridge sleeve assembly attached to the terminal end of the production tubing disposed within the well. The sleeve assembly helps maintain the cartridge unit in a stationary position for fluid pumping purposes. The motor-pump cartridge unit may be raised or lowered by a control cable disposed within the production tubing for helping to facilitate the repair or replacement of the motor and/or pump unit.

Briefly, the above and further objects of the present invention are realized by providing a new and improved linear motor-pump assembly and method of using it for downhole use. The assembly includes a cartridge unit with a linear motor attached threadably between a discharge housing assembly adapted to be secured removably to a cable for hoisting the cartridge unit through the production tubing of a well and a suction housing assembly for facilitating the pumping of well fluids from a downhole well. The linear motor includes a mover adapted to engage threadably a stop valve for permitting one-way flow of fluid through the mover and into the discharge housing for discharge into the production tubing. For increased pumping efficiency, the suction housing and check valve are replaceable with a lifting pump and piston respectively. In addition, the linear motor has a modular construction permitting additional sections to be added for increasing thrusting capacity. Thus, the assembly is usable in both shallow and deep wells.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 11:
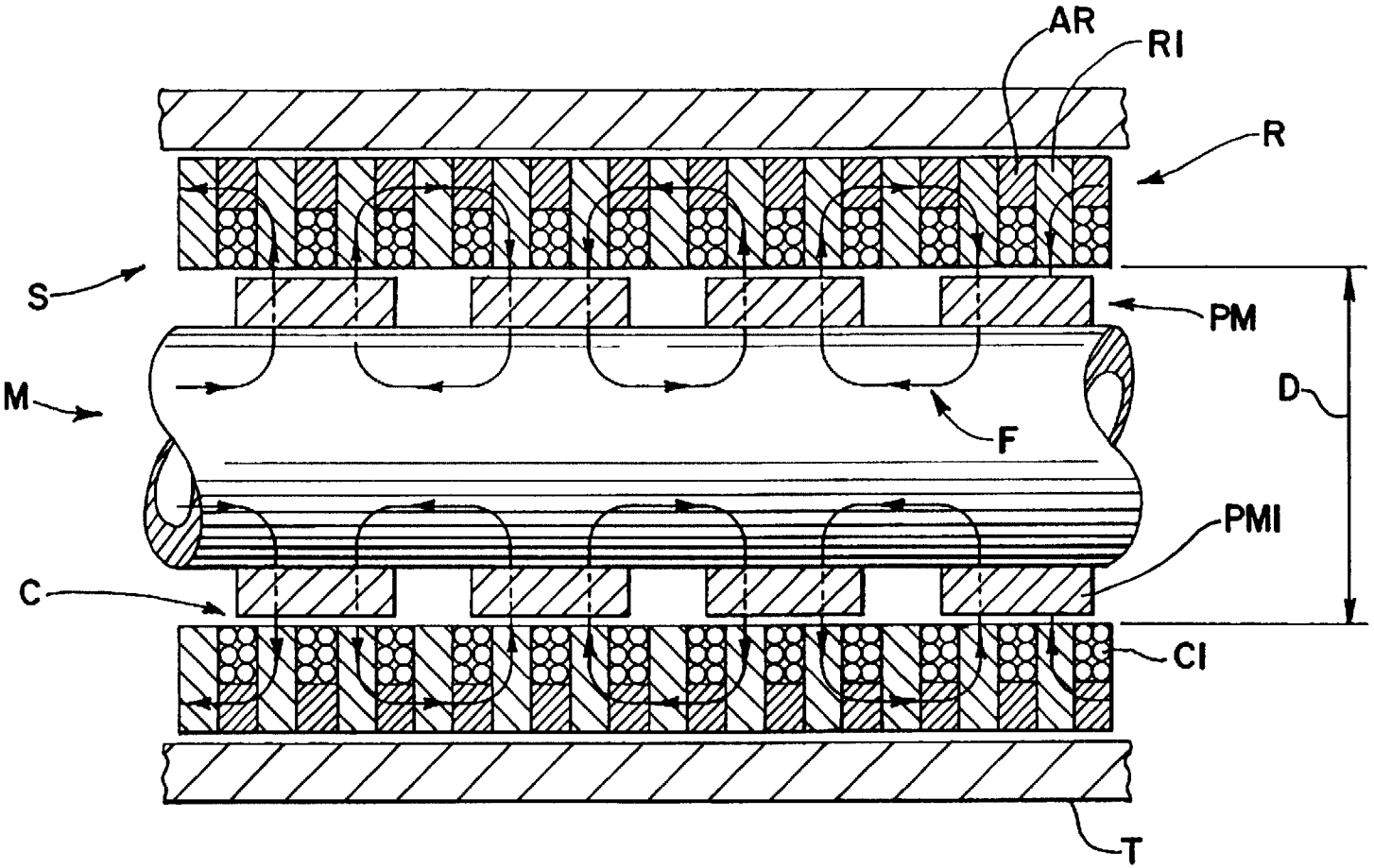
Fig. 11 PRIOR ART
FIG. 11 is a prior art tubular linear motor having a large diameter stator and solid mover.
Figure 12:
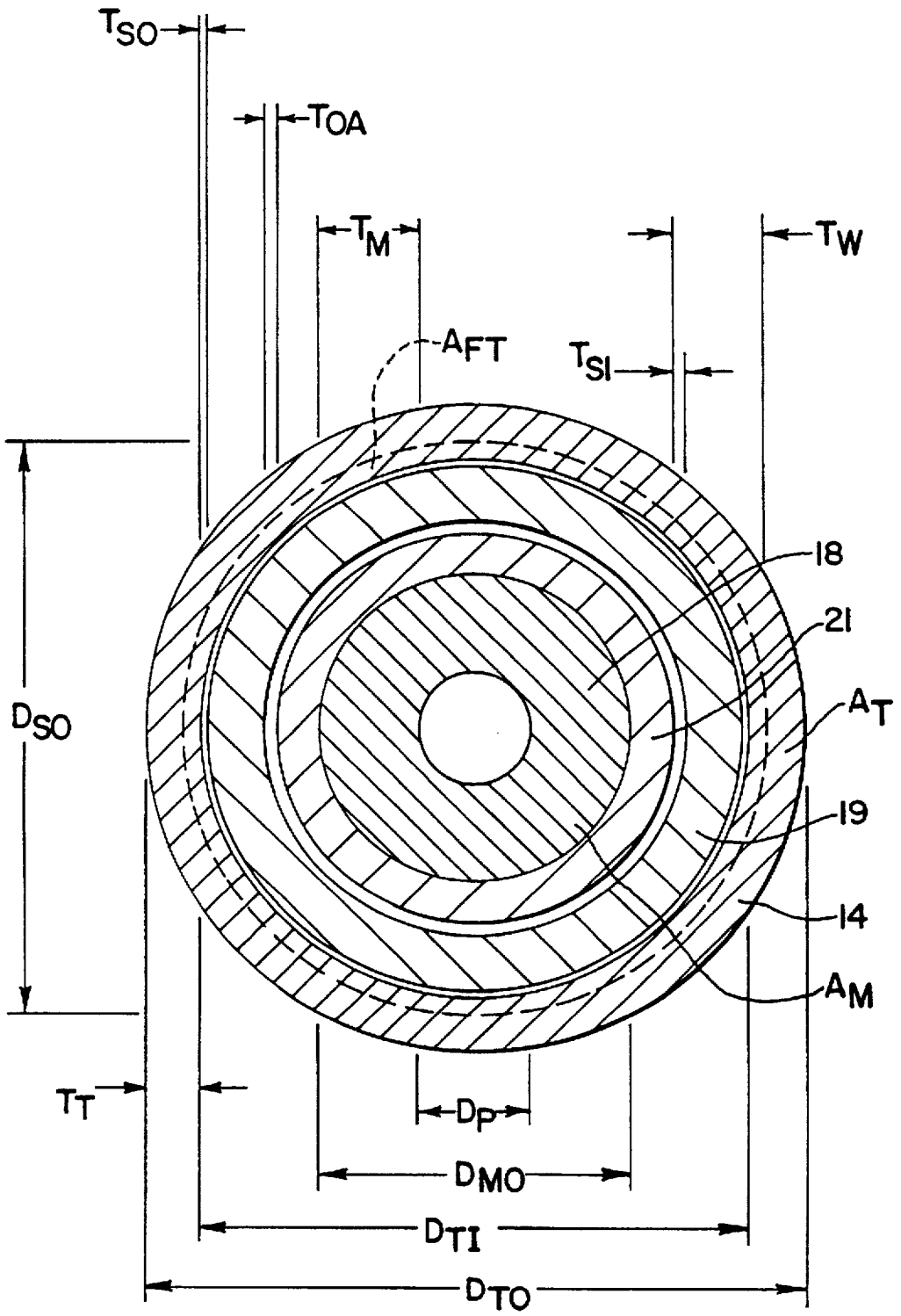
FIG. 12 is a diagrammatic, transverse sectional view of the linear tubular motor of FIG. 2 helpful in the understanding of the present invention.

As best seen in FIG. 11, a tubular linear electric motor M built in accordance with prior known conventional practices for use inside a steel tube T, includes a stator S having a set C of electric coils, including a coil C1 separated axially from each other by a set R of annular iron rings or teeth, including an annular ring R1. The prior art motor also includes a mover M with a set PM of permanent magnets, including a permanent magnet PM1. The magnets PM are mounted on the mover for producing fields of magnetic flux, indicated generally as F. The mover M is mounted for movement relative to the stator S.

The teeth and the coils of the stator S are surrounded on the outside by annular steel or iron rings, such as a ring AR which form the yoke or back-iron of the stator of the motor. The function of the yoke or the stator of the motor is to provide an axial path for the lines of magnetic flux flowing axially on the outside of the motor from one magnetic pole to another.

Thus, the yoke of the motor is an integral part of the motor, and must be small enough to fit inside the steel tube T if such a tube were the conventional production tubing of an oil or water well (not shown), or such other application. As a result, the radial dimensions of the yoke and the coils fitting inside the yoke are such that the dimension of the critical air gap diameter D between the internal diameter of the coils and the outside diameter of the mover of the motor is severely restricted.

Referring now to the drawings, and more particularly to FIGS. 1–3, 5 and 12 thereof, there is shown a tubular linear motor 10 which is constructed in accordance with the present invention and which is illustrated connected to a separate pump P downhole in a well, such as an oil well 12 having a production tube or tubing 14 disposed therein for passing of well fluids 15 from downhole to the upper surface 16. The linear motor 10 can be constructed and used in accordance with the methods of the present invention, and can be used not only in connection with a pump, but also in connection with other applications as well.

The motor 10 generally comprises an elongated hollow rotor or mover 18 (FIG. 2) having a ferromagnetic core 62 with a centrally disposed axial hole 63 extending throughout its entire axial length for passing fluids from one end of the mover 18 to an opposite end of the mover 18. A plurality of spaced apart bipolar annular permanent magnets 20–23 are mounted on the mover core 62 for producing magnetic flux to facilitate the production of electromagnetic forces as will be explained hereinafter in greater detail.

The motor 10 also includes a three-phase stator assembly 19 for carrying three-phase electrical current to interact with the magnetic flux produced by the magnets 20–23. In this regard, the stator assembly 19 includes a winding 32 having a set of electrical coils, such as a first phase set 35 of coils, a second phase set 37 of coils and a third phase set 39 of coils. Winding 32 will be described hereinafter in greater detail.

The stator assembly 19 also includes a set of annular ferromagnetic rings 50–61 which provide flux paths for the flux produced by the mover magnets, such as the magnets 20–23. The rings are each preferably composed of iron.

The stator assembly 19 has a small outside diameter $D_{SO}$ which is about the same diameter as the inside diameter $D_{TI}$ of the production tube 14. In this regard, the diameter of the stator assembly 19 is sufficiently small so that the stator assembly 19 may be easily raised and lowered within the production tube 14. As will be explained hereinafter, in order to protect the stator coils 35, 37 and 39, as the stator assembly 19 is raised and lowered with the production tube 14, the coils are covered with a suitable protective adhesive.

The stator assembly 19 is also dimensioned so that the annular iron rings 50–61 and the wall of the production tube 14 surround a substantial portion of each of the winding coils 35, 37 and 39 to facilitate interaction between the magnetic flux produced by the magnets 20–23 and the three-phase electrical current flowing through the coils 35, 37 and 39. In this regard, the stator assembly 19 cooperates with the production tubing 14, which is composed of a suitable ferromagnetic material such as iron or steel, and the mover core 62 to form a plurality of magnetic flux paths 24, 26, 28, 30 and 25, 27, 29 and 31.

The production tubing 14 also functions as a heat sink which dissipates the thermal energy generated by the electrical current flowing through the coils in the stator assembly 19. In this regard, the wires carrying the electrical current in the stator assembly 19 are disposed in such close proximity to the production tubing 14, that the production tubing 14 is able to absorb the heat generated in the motor windings. As a result of having such a large heat sink, the motor 10 can accommodate larger amounts of electrical current without unwanted and undesired overheating.

Figure 9:
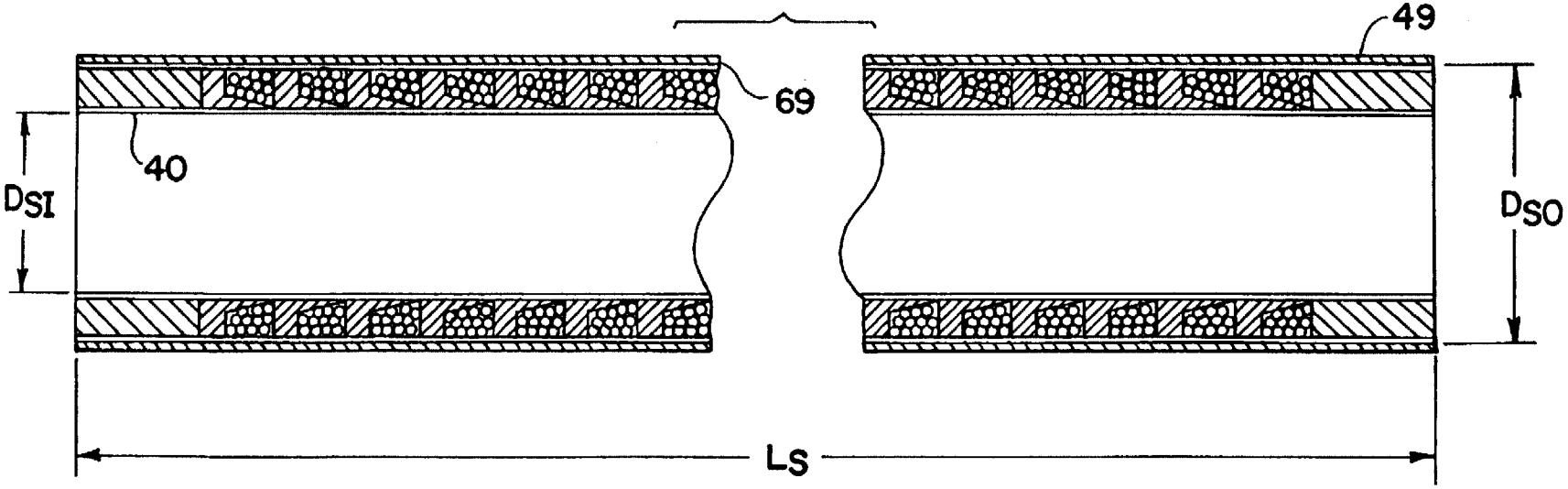
FIG. 9 is a fragmentary elevational view of the stator of FIG. 8, illustrating final assembly with a protective cover in accordance with the present invention.

The ability to accommodate the larger amounts of electrical current in turn, improves significantly the axial thrust or force developed by the motor 10. Thus, the axial length ($L_S$) (FIG. 9) of the motor can be significantly reduced. Table I shows a comparison between the axial length of a prior art tubular linear motor with an exemplary tubular linear motor constructed in accordance with the present invention.

TABLE I

| CHARACTERISTICS | PRIOR ART MOTOR | INVENTIVE MOTOR |
|---|---|---|
| THRUST $F = D_{SI}^2 L_S$ | 500 POUNDS | 500 POUNDS |
| DIAMETER OF AIR GAP ZONE ($D_{SI}$) | 1.140 INCHES | 1.250 INCHES |
| AXIAL LENGTH OF AIR GAP ZONE ($L_S$) | 252 INCHES | 156 INCHES |
| INSIDE DIAMETER OF PRODUCTION TUBING | 1.867 INCHES | 1.867 INCHES |

From Table I, it will be understood by those skilled in the art, that the inventive tubular linear motor has a 62% reduction in its overall axial length, compared to the conventional tubular linear motor. Moreover, the inventive motor of Table I has a significantly greater outside diameter as compared to conventional prior known tubular linear motors. Thus, although the inventive motor described in Table I is substantially the same in its overall cross-sectional area for carrying substantially the same amount of magnetic flux in its mover core 62 as the prior art motor, the increased outside diameter of the motor allows the mover 18 to have a diameter hole or passageway extending along its entire axial length, such as a 0.38 inch diameter hole. This passageway provides an adequate pathway for well fluids 15 to flow through the mover 18, as the fluid 15 is being pumped and removed from the well 12.

In operation, when the mover 18 is disposed within the stator 19, the permanent magnets 20–23 generate magnetic flux flowing through a plurality of outer and inner magnetic flux paths. The magnetic flux, in turn, interacts with the current carried by the coils 35, 37 and 39 to produce an electromagnetic axial force of a given magnitude. For example, referring to FIGS. 2 and 12, the permanent magnets produce an outer magnetic flux path area $A_{FP}$ (not shown) that includes an annular cross-sectional stator area flux path $A_S$ and an annular cross-sectional ferromagnetic tube area flux path $A_{FT}$, which is a portion of the overall tube area $A_T$.

Figure 1:
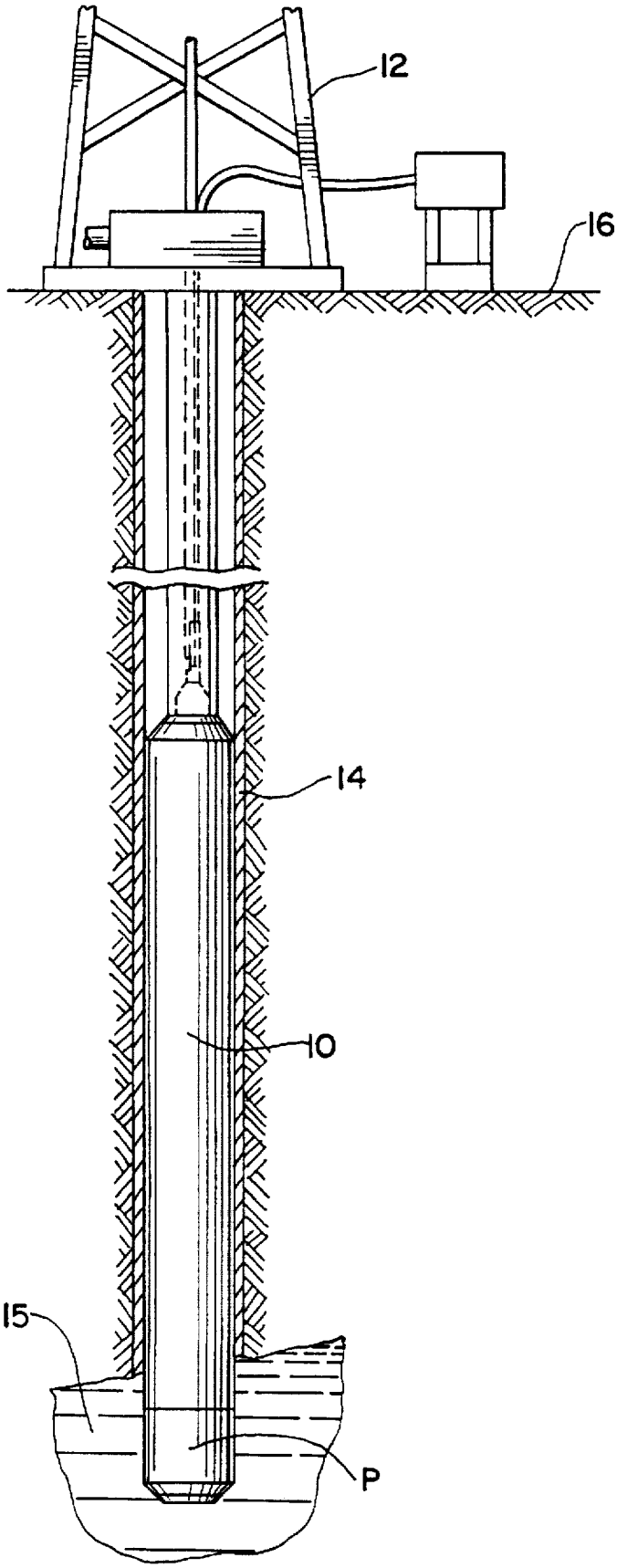
FIG. 1 is an elevational, partially diagrammatic view of a tubular linear pump motor which is constructed in accordance with the present invention, and which is illustrated downhole in a fluid producing well.
Figure 2:
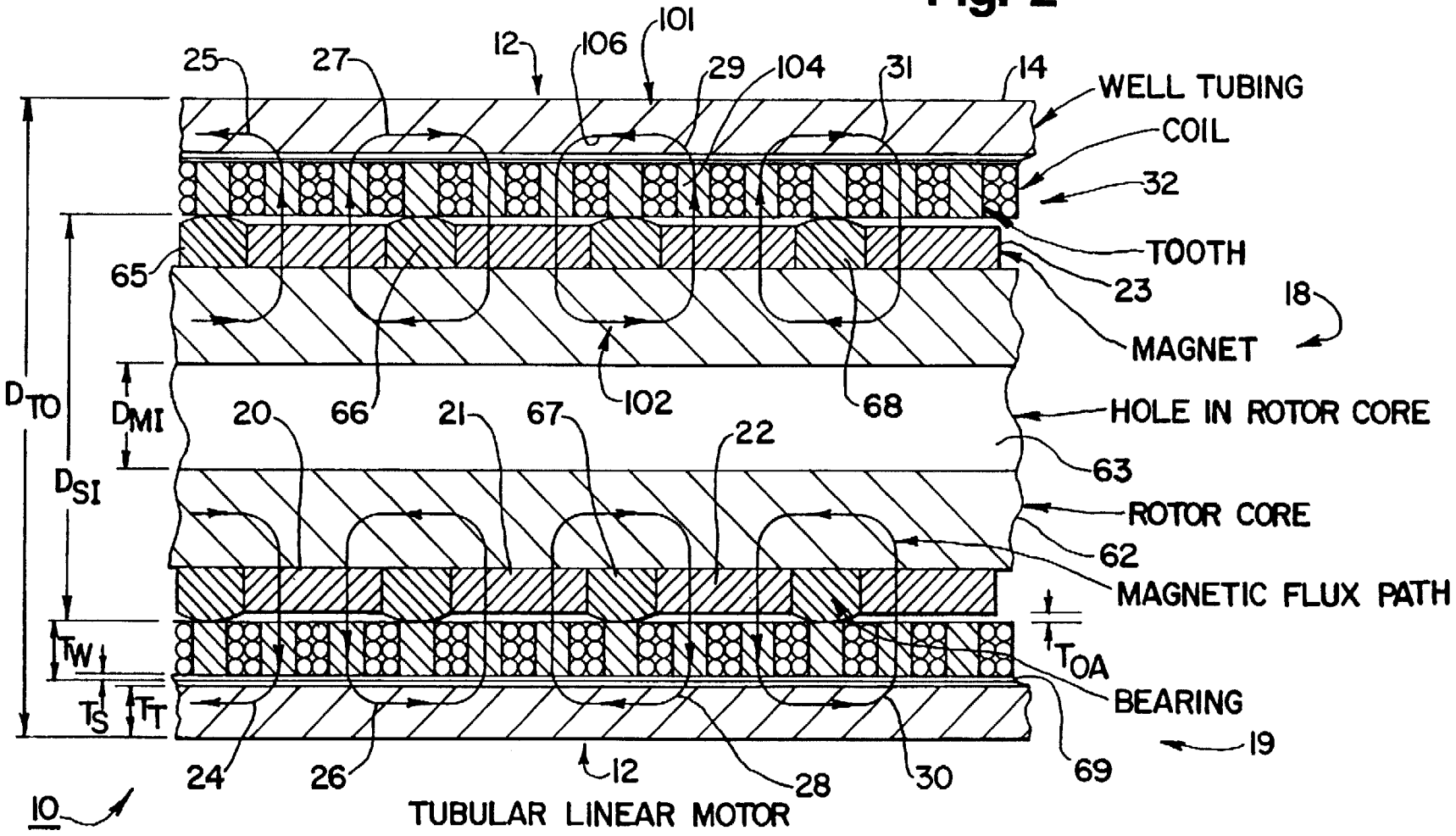
FIG. 2 is a greatly enlarged, fragmentary diagrammatic axial sectional view of the tubular linear pump motor of FIG. 1.

As further clarification of the flux paths consider the flux paths 24–31 with reference to FIG. 2. As each of these paths are substantially the same, only flux path 29 will be considered in greater detail.

As best seen in FIG. 2, the flux path 29 includes an outer flux path portion 106 and an inner flux path portion 102 which portions are separated from one another by a pair of permanent magnets, such as the magnets 21 and 22. The outer flux path portion 100 includes a stator iron core path portion 104, which extends across the entire transverse width of the stator defined by $T_W$, and a production tube ferromagnetic core path portion 106. As best seen in FIG. 2, the production tube portion 106 does not extend a substantial distance into the production tube.

In accordance with the present invention, the axial width of each stator tooth, such as the tooth 84 of the stator ring 50 (FIG. 3), should be as thin as possible to help reduce the overall length of the motor. The tooth 84 must also be sufficiently thick to permit sufficient magnet flux to flow from the magnets so that the tooth does not unduly restrict the lines of flux.

Furthermore, in accordance with the present invention, as shown in FIG. 2, the flux lines linking the stator and the mover are annular shaped. The flux paths, such as the paths 28 and 29, represent axial sections of the annular lines of magnetic flux. According to the invention, the radial transverse area $A_T$ of the production tubing should be related to the axial tooth area $A_S$ (area of the stator), preferably as follows:

$$\frac{A_S}{A_T} = \text{about } 1.0. \quad (1)$$

This is important, because for a given size area of the tooth, the minimum area of the production tube should be about the same as the area of the stator tooth. It has been determined according to the present invention that there is a critical general relationship of the following:

$$\frac{A_S}{A_T} = \text{between about 1.0 and about 1.25.} \quad (2)$$

A more preferred range is, as follows:

$$\frac{A_S}{A_T} = \text{between about 0.75 and about 1.0.} \quad (3)$$

Also, according to the invention, for a given tooth area AT, the core mover area $A_M$ is greater than or equal to the stator tooth area $A_S$. In this regard, the more preferred relationship is as follows:

$$\frac{A_S}{A_M} = \text{about 1.0.} \quad (4)$$

It has been determined that the overall critical relationship, in general, is as follows:

$$\frac{A_S}{A_M} = \text{between about 0.1 and about 1.25.} \quad (5)$$

A more preferred ranges is, as follows:

$$\frac{A_S}{A_M} = \text{between about 0.75 and about 1.0.} \quad (6)$$

Figure 4:
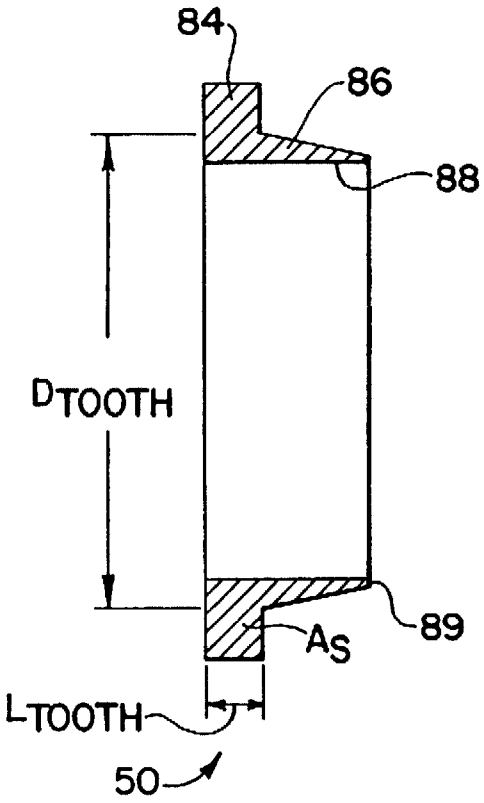
FIG. 4 is a sectional view of the stator ring of FIG. 3 taken substantially on line 4—4 thereof.

With particular relationship to the following relationships by way of definition apply:

$$A_S = \pi D_{TOOTH} L_{TOOTH}, \text{ as shown in FIG. 4.}$$

$$A_T = \pi \frac{(D_{TO}^2 - D_{SI}^2)}{4} \quad (7)$$

$$A_M = \pi \frac{(D_{MO}^2 - D_{MI}^2)}{4}$$

Figure 3:
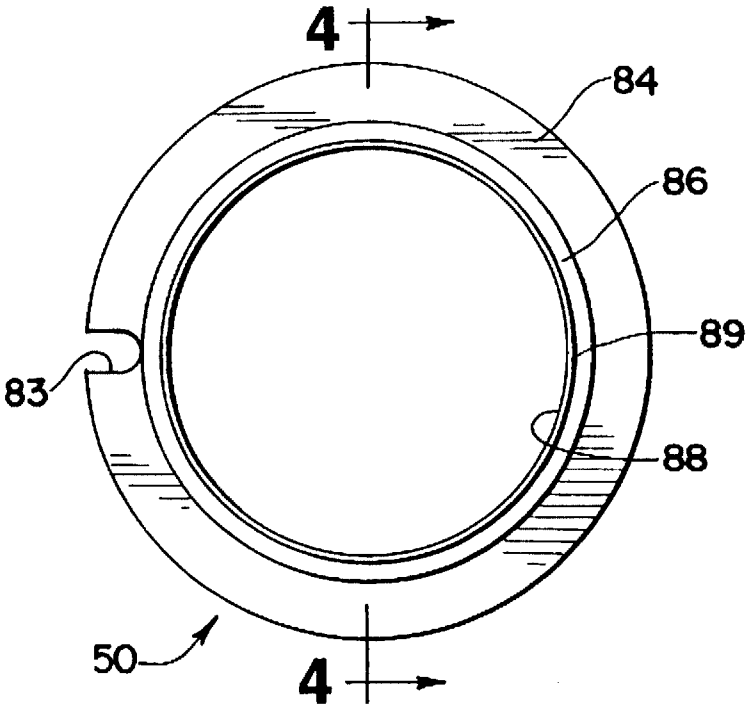
FIG. 3 is a face view of a stator ring forming part of the motor stator of FIG. 2.

Considering now the stator assembly 19 in greater detail with reference to FIGS. 2–4, the stator assembly 19 generally comprises a non-ferromagnetic tubular mandrel or tube 40 having threaded ends, indicated generally at 42 and 44. The threaded ends 42 and 44 are adapted to receive thereon a pair of stator end caps 46 and 48, respectively. In this regard, the stator end caps 46 and 48 help retain the annularly-shaped iron rings, such as the annular rings 50–61 on the tubular mandrel 40. The annular rings 50–61 function as stator teeth and are to be constructed to form a plurality of spaced apart annular coil receiving slots, such as slots 70–81.

The annular rings 50–61 and the associated windings 35–39 once assembled on the mandrel 40 are encapsulated with a suitable non-conductive highly wear resistant protective adhesive covering, such as an epoxy covering. For additional protection, an iron outer protective sheath or sleeve 49 cover the epoxy covering. The sleeve 49 is threaded internally and is adapted to threadedly receive the end caps 46 and 48 therewithin.

While a protective sleeve, such as the sleeve 49 is shown in the preferred embodiment, it will be understood by those skilled in the art that the protective sleeve is not required as the epoxy sealing the coils 35–39, is sufficient protection against the downhole environmental conditions. In this regard, the epoxy is resistant to brine and oil and is able to withstand temperatures of up to 125° C.

Considering now the annular rings 50–61 in greater detail, as each of the rings 50–61 are substantially similar, only ring 50 will be considered in greater detail.

As best seen in FIGS. 3 and 4, the annular ring 50 has a unitary construction and includes an annular-shaped base member 84 with an integrally connected centrally disposed upstanding flange or conical member 86. A centrally disposed opening 88 having a uniform diameter extending the entire axial length of the annular ring. In this regard, the inside diameter of the ring 50 is dimensioned to be slightly larger than the outside diameter of the mandrel 40 so that the ring 50 may be mounted on the mandrel 40 in an easy and convenient manner to facilitate construction of the stator assembly 19.

As best seen in FIG. 3, the outside diameter of the base member 84 is substantially greater than the outside diameter of the conical member 86. In this regard, the conical member 86 extends angularly upwardly from the top surface of the base member 84 terminating in a lip 89 which defines the opening 88.

A crossover cutout or slot 83 extends between the outside peripheral boundary of the base member 84 and the outside peripheral boundary of the conical member 86 where it is joined to the base member 84. The slot 83 provides a passage for the "crossover" wires from one phase winding to another phase winding, such as phase windings 35 and 37.

Figure 5:
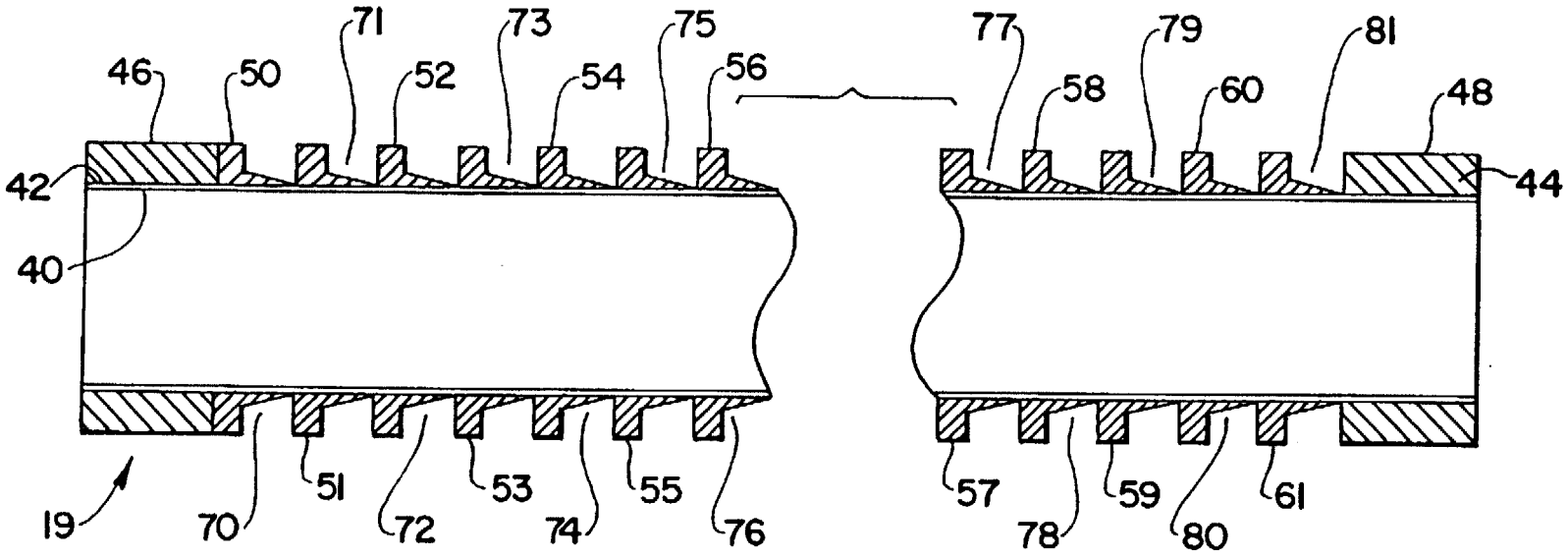
FIG. 5 is a fragmentary elevational view of the stator of the motor of FIG. 2 prior to it being wound with electrical coils.
Figure 6:
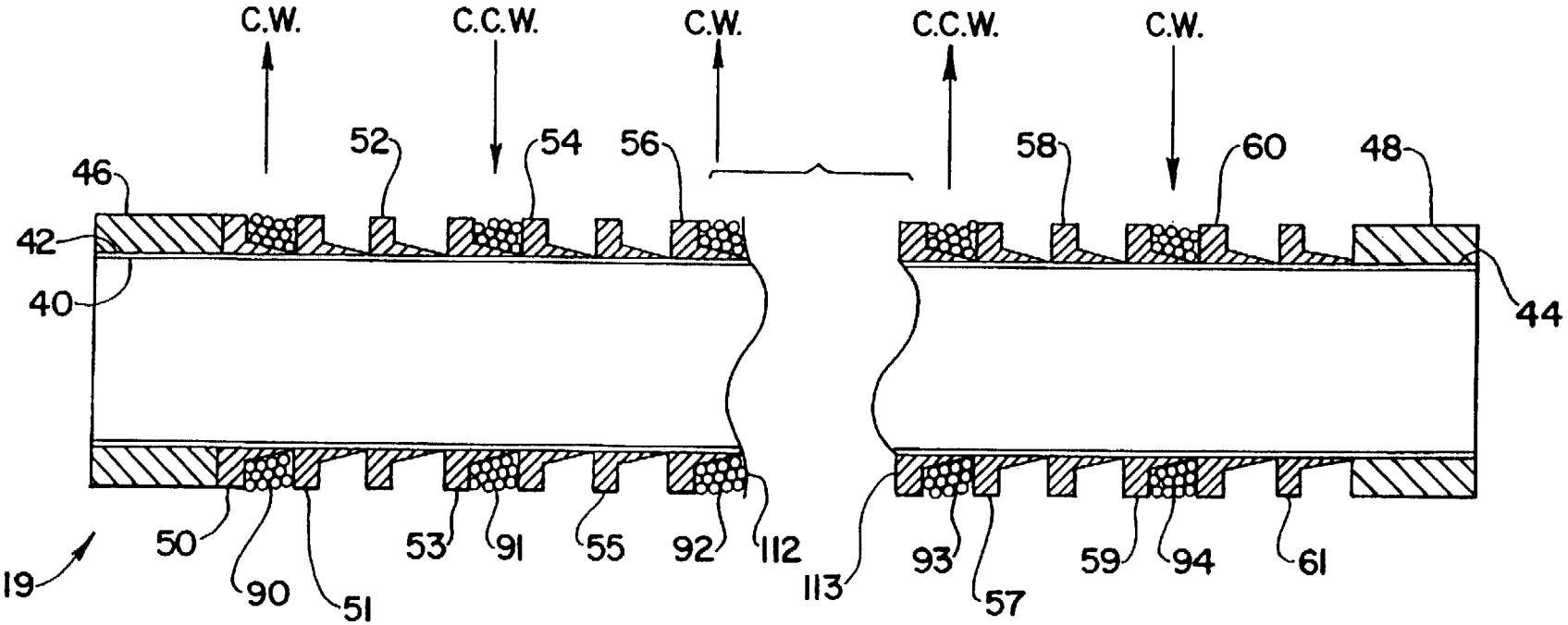
FIG. 6 is a fragmentary elevational view of the stator of FIG. 5, illustrating a first one of three phase coils being wound thereon in accordance with the present invention.
Figure 7:
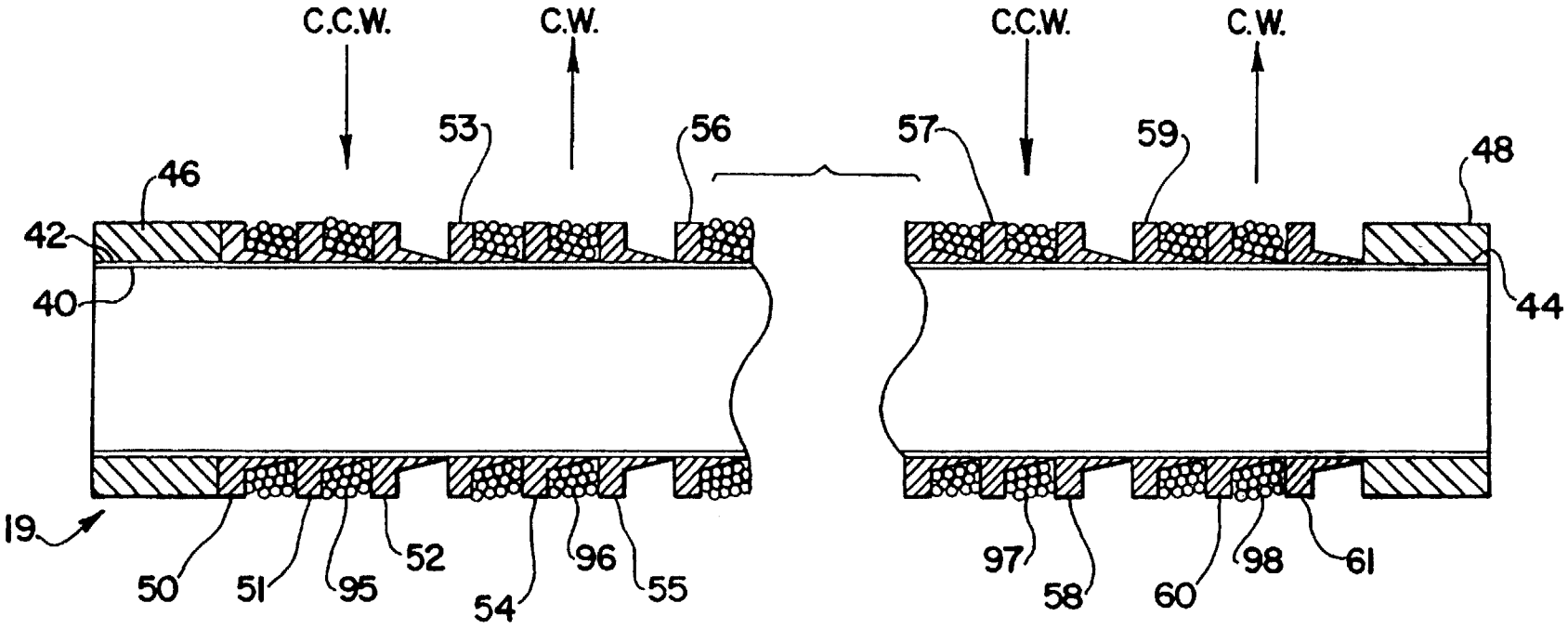
FIG. 7 is a fragmentary elevational view of the stator of FIG. 6, illustrating a second one of three phase coils being wound thereon in accordance with the present invention.
Figure 8:
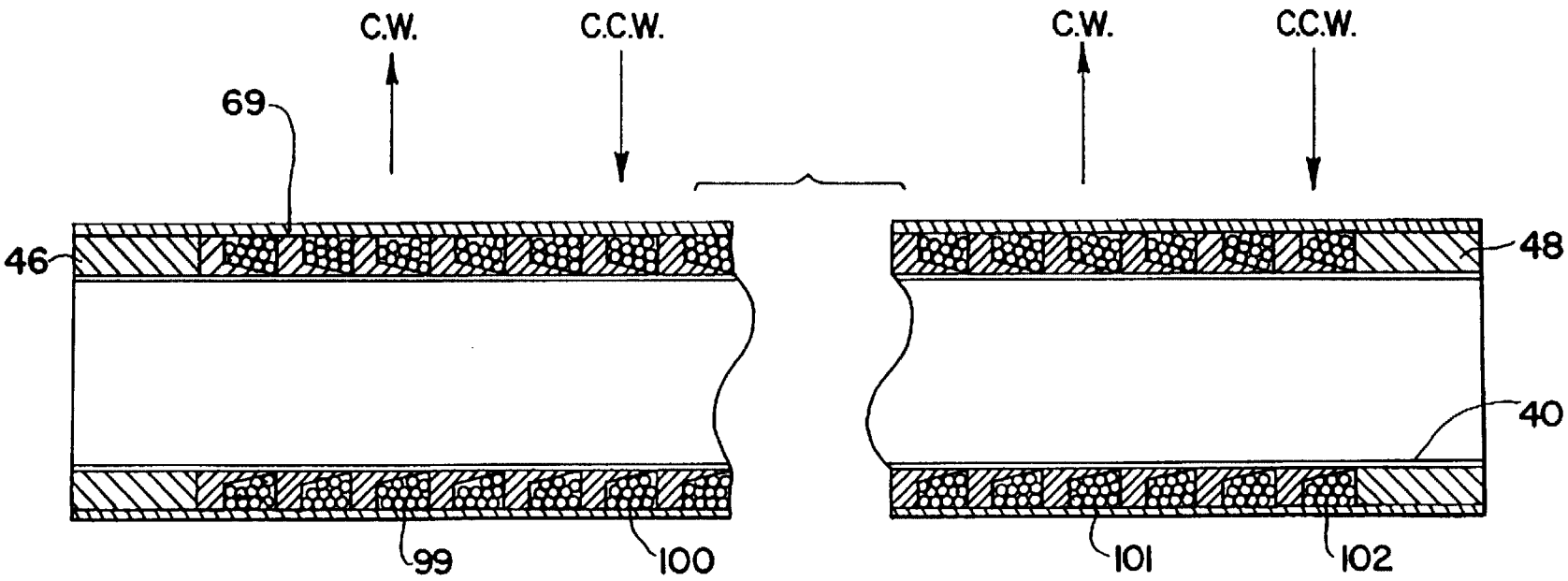
FIG. 8 is a fragmentary elevational view of the stator of FIG. 7, illustrating a third one of three phase coils being wound thereon in accordance with the present invention.

Considering now the coil windings 35, 37 and 39 with respect to FIGS. 5, 6 and 7, the first phase winding 35 generally includes a set of integrally connected coil windings such as windings 90–94 which are disposed in coil winding slots 70, 73, 76A and 79, respectively, and which are formed from a single, uninterrupted wire to avoid the necessity of numerous electrical connections. Each of the windings 90–94, such as the winding 90, includes a large number of turns of wire that completely fills the space between the oppositely disposed base members, such as base members 50 and 51. In this regard, each winding extends to the outer peripheral boundary of its associated base members, such as the outer peripheral boundary at base members 50 and 51.

In order to eliminate the need for numerous electrical connections between the windings, a singled wire forms winding 35 and extends between each of the slots 70, 73, 76A and 79, the wire of the winding 35 crosses over unused slots via the respective crossover slots, such as the crossover slot 83. To assure conventional proper phase winding of the coils, the first phase, or phase winding A, is wound in its associated slots 70, 73, 76A and 79 in alternating clockwise and counter-clockwise directions as illustrated in FIG. 6.

Considering now the second phase winding 37 in greater detail with reference to FIG. 6, the second phase, or phase B winding 37, is similar to the first phase winding 39 and generally includes a set of coil windings 95–98 which are disposed in coil winding slots 71, 74, 77, 80, respectively. Windings 95–98 are wound alternately in counter-clockwise and clockwise directions out of phase with winding A. It should be noted, however, that with respect to the adjacent phase A winding 35, the second phase, or phase B winding 37, is wound in an opposite clockwise/counter-clockwise directions.

Considering now the third phase winding 39 in greater detail with respect to FIG. 7, the third phase, or phase C winding 39, is similar to phase windings 35 and 37 and generally includes a set of coil windings 99–102 which are disposed in coil winding slots 72, 75, 78, 81, respectively. Windings 99–102 are wound in alternate clockwise and counter-clockwise directions, relative to each respective slot.

Figure 10:
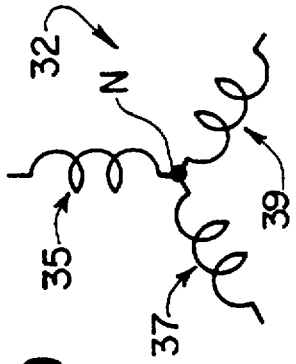
FIG. 10 is a schematic wiring diagram of the three phase stator windings of FIG. 9.

Considering now the windings 35–39 in still greater detail as shown in FIG. 10, the winding 35–39 are interconnected electrically at a common node N at one of each of their ends and are adapted to be connected electrically to a multiple phase power source (not shown) at their opposite ends. Thus, the windings can be formed in a fast, convenient manner.

Considering now the mover 18 in greater detail with reference to FIG. 2, the mover 18 has an outside diameter $D_{MO}$ and an inside diameter $D_P$ and is composed of a suitable ferromagnetic material for the establishment of a plurality of magnetic flux paths therein, such as the flux paths 25–31.

In order to permit relative movement of the mover 18 within the stator assembly 19, the mover also includes a set of spaced apart annular bearings, such as bearings 65–68. The bearings 65–68 engage the adhesive coating 69 to permit substantially friction-free movement along the hardened epoxy surface.

Each of the bearings 65 to 68 are substantially similar, and thus only bearing 65 will be described hereinafter.

Referring to FIG. 2, bearing 65 is annular in construction having a smoothly rounded outer surface for engaging the inside surface of the stator assembly 19. The bearing 65 also includes a smoothly rounded inner surface for mounting the bearing to the cylindrical-shaped hollow mover 18.

The mover 18 is attached at one of its free ends (not shown) to a pump (not shown) for receiving fluids. The opposite free end of the mover 18 is disposed within the interior of the tube 14 for discharge of fluids to the surface 16 of the well 12.

Within the true scope of the present invention, an induction type linear motor is contemplated, and all of the foregoing description, including the formula, apply equally to an induction motor as well as to a permanent magnet motor. Also, the preferred magnetic orientation of the permanent magnets is radial, but axially magnetizes permanent magnets may also be employed.

Figure 13:
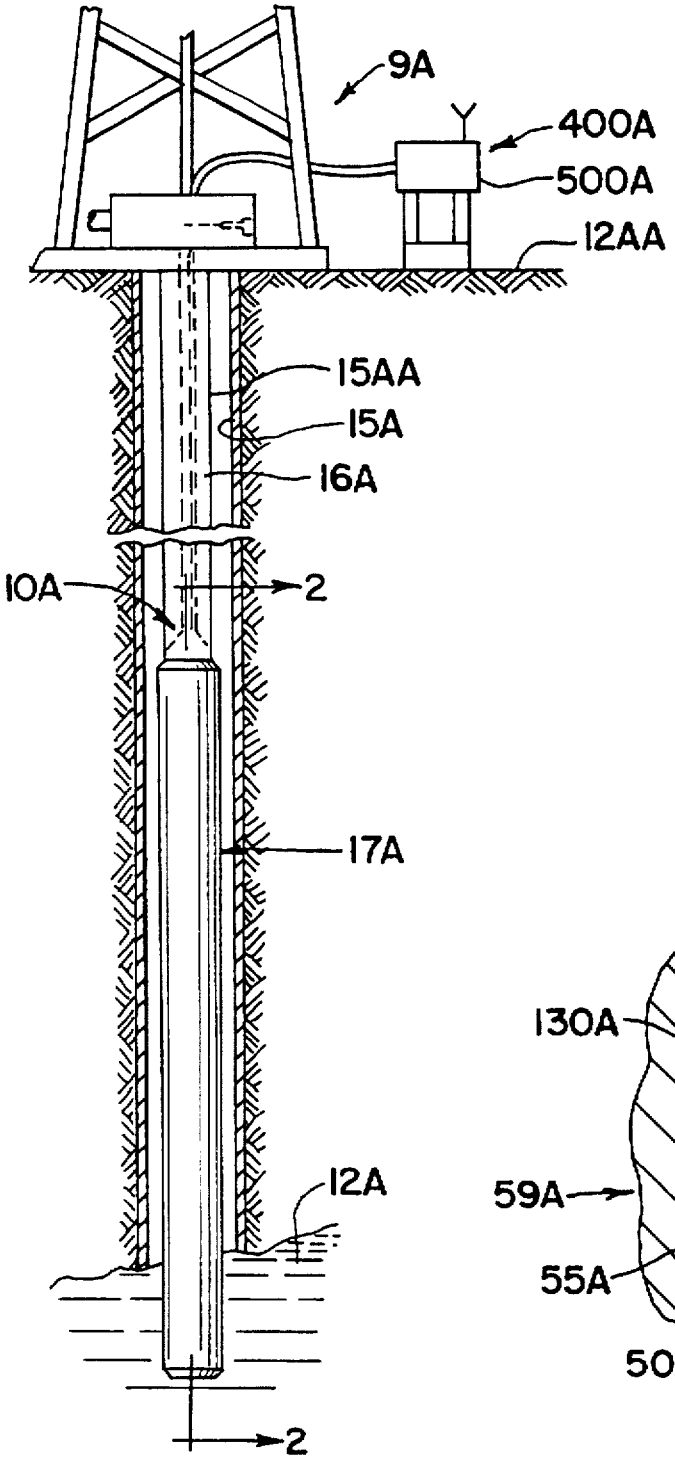
FIG. 13 is a sectional view of a well containing a linear d.c. motor which is constructed in accordance with the present invention and which is shown disposed in a motor-pump cartridge unit assembly for illustrative purposes.
Figure 14:
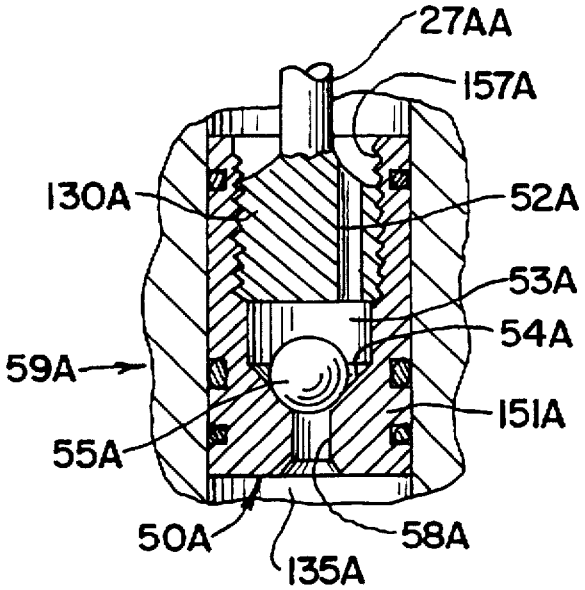
FIG. 14 is a greatly enlarged partially cut away cross sectional view of the motor-pump cartridge unit disposed within the production tubing of the well of FIG. 13, taken substantially on line 2—2.
Figure 16:
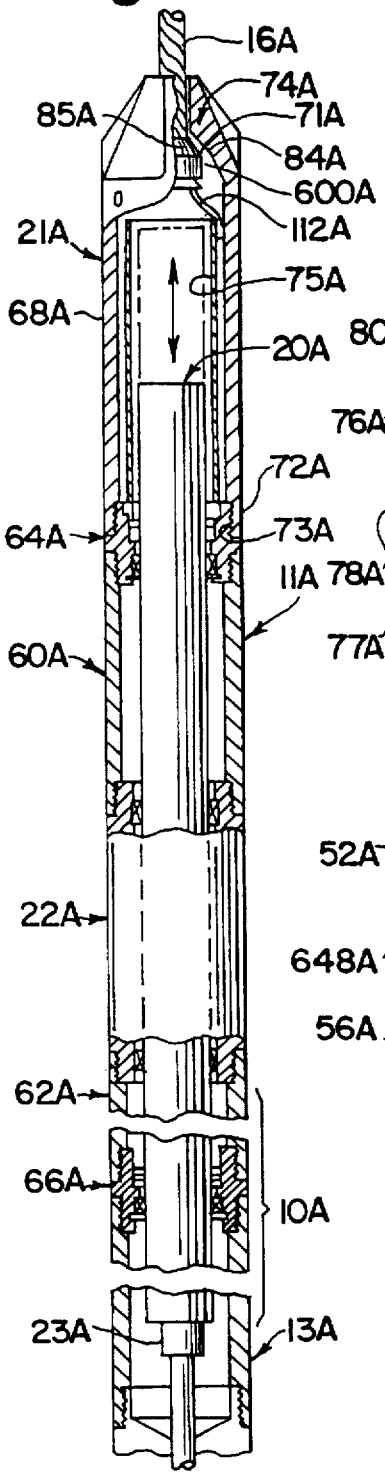
FIG. 16 is a reduced cross sectional view of a linear d.c. motor assembly taken substantially on line 4—4 of FIG. 14, which is constructed in accordance with the following invention.

Referring to FIGS. 13, 14 and 16 thereof, there is shown a pump control system 9A for use with a motor pump cartridge unit or assembly 10A including a sucker rod pump 13A (FIG. 14) and a downhole brushless linear direct current motor assembly 11A, (FIG. 16) which is constructed in accordance with the present invention. The linear direct current motor assembly 11A is a nonsalient pole synchronous machine with a large magnetic air gap and is shown in FIG. 14 in an operative downhole position for driving the sucker rod pump 13A reciprocatively to pump well fluids, such as the fluids 12A, from downhole to the surface 12AA. The linear motor assembly 11A is electrically connected to a motor controller 400A for controlling the motor current levels to provide hysteresis control. The linear direct current motor assembly 11A and the sucker rod pump 13A are mechanically coupled together to form the motor-pump cartridge unit 10A for pumping well fluids 12A from a conventional oil well.

Figure 19:
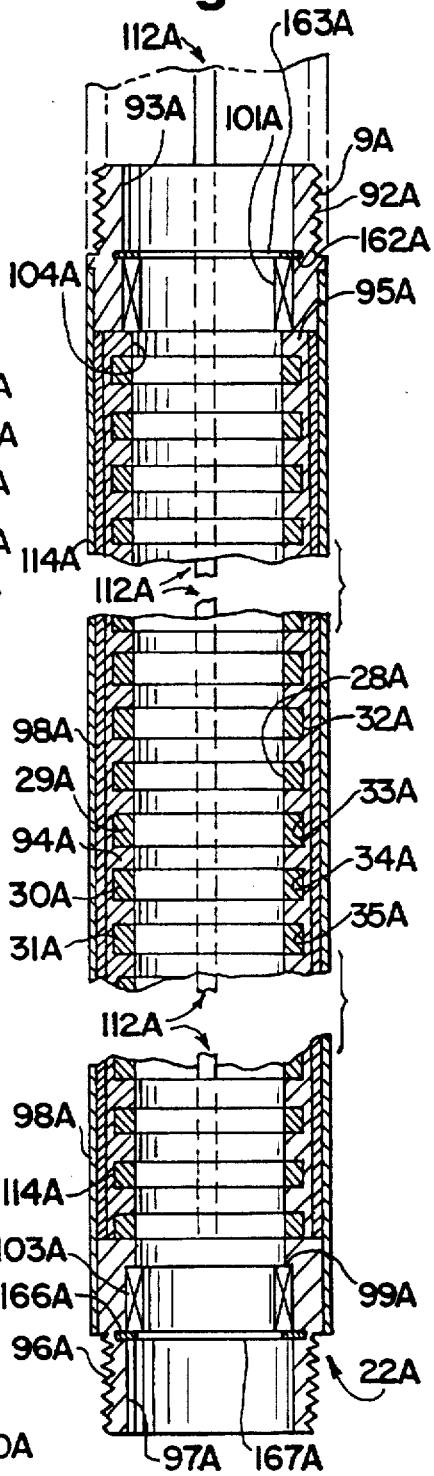
FIG. 19 is a cross sectional view of the stator forming part of the linear d.c. motor assembly of FIG. 16.
Figure 20:
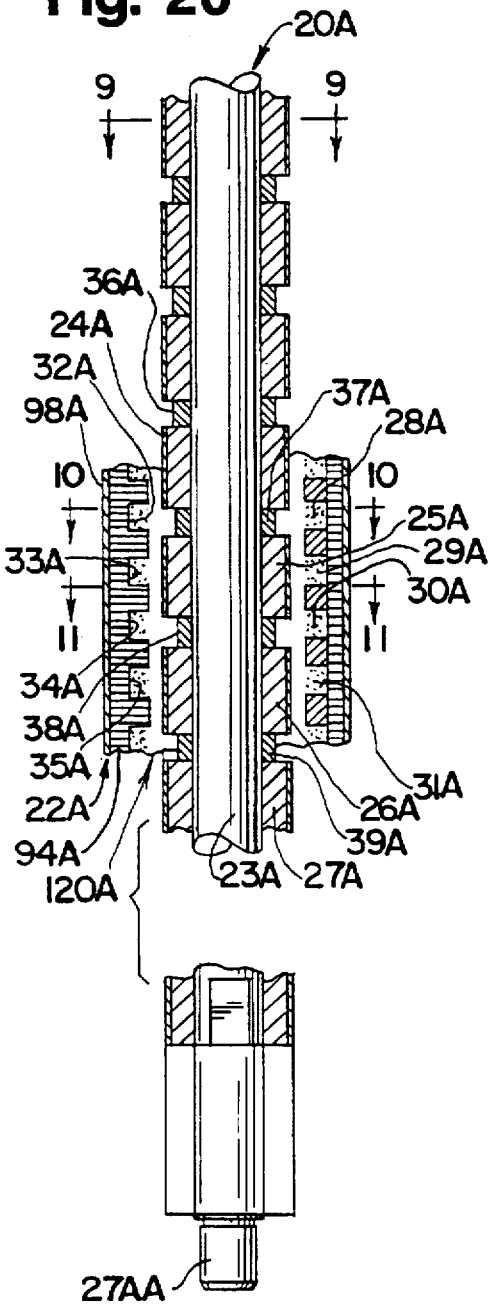
FIG. 20 is an enlarged partially fragmentary view of the mover and stator forming part of the linear d.c. motor assembly of FIG. 14.
Figure 21:
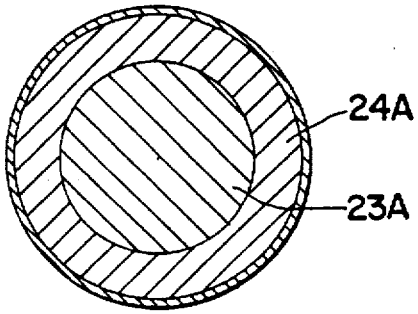
FIG. 21 is a transverse cross sectional view of the mover of FIG. 20 taken substantially along lines 9—9.

As will be explained hereinafter in greater detail, the motor assembly 11A includes a mover or actuator 20A (FIGS. 14 and 20), a motor housing 21A (FIG. 16) and a cylindrically shaped hollow body stator 22A (FIGS. 19 and 20). The mover 20A coacts electromagnetically with the stator 22A causing the mover 20A to travel reciprocatively rectilinearly within the hollow interiors of the housing 21A and the stator 22A as the stator 22A is electrically energized by the controller 400A.

Figure 24:
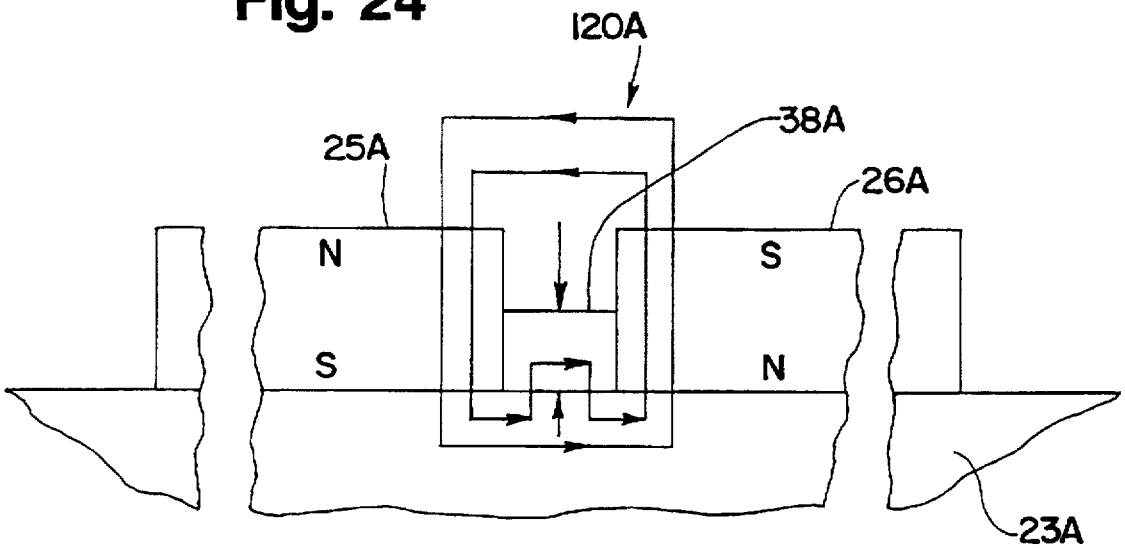
FIG. 24 is a greatly enlarged diagrammatic fragmentary view of a spacer forming part of the mover of FIG. 20, illustrating the path of the magnetic flux lines passing through the spacer.

As best seen in FIG. 20, the mover 20A is slidably mounted within the stator 22A and includes a series of spaced apart annularly shaped magnets, such as magnets 24A, 25A, 26A and 27A mounted along the longitudinal axis of a rod or shaft 23A. The magnets mounted on the shaft 23A are spaced apart from one another by a set of annular iron shunting rings or spacers, such as spacers 36A–39A. The spacers are interleaved with the magnets in order to help reduce core flux density and thus, improve motor performance. In this regard, as best seen in FIG. 24, the spacers such as spacer 38A cause magnetic flux shown generally at 120A, produced by the magnets, such as the magnets 25A and 26A, to take a bypass or alternate path through the spacers thus reducing the amount of magnetic flux entering the stator core.

Also in order to help to reduce substantial coil reaction fields, the thickness of the individual spacers is substantially less than the thickness of the individual magnets. In this regard, the thickness of the individual magnets and spacers is determined by the speed of the motor, and more particularly to help establish a desired pole pitch between two consecutive magnets.

Figure 33:
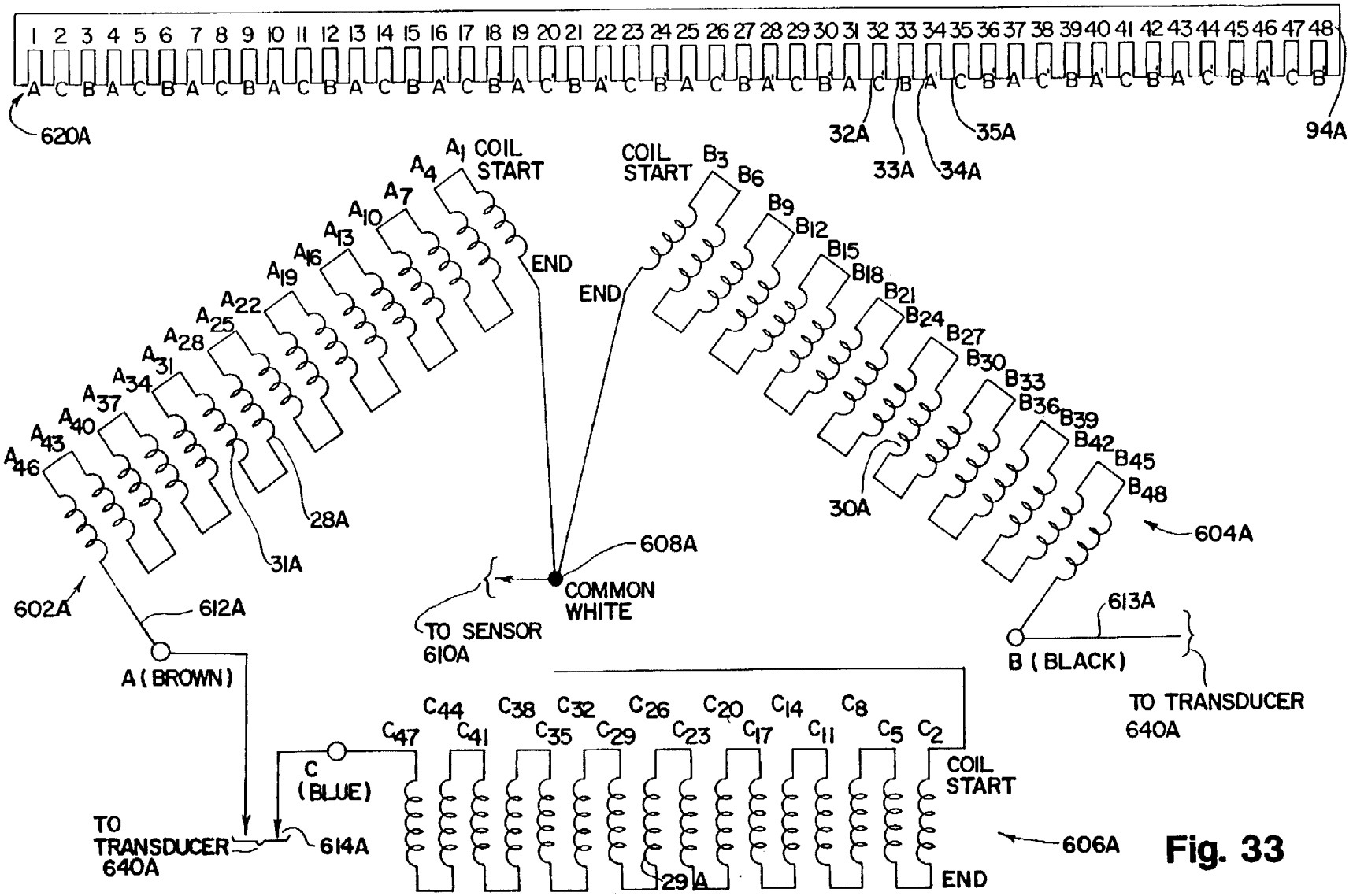
FIG. 33 is a partial diagrammatic and schematic representation of the stator coil winding phase groups and their locations relative to the stator core of FIG. 19.

As best seen in FIG. 19, the stator 22A includes a laminated core 94A with an internal bore 104A having a sufficient diameter to permit the unimpeded reciprocative movement of the mover 20A within the stator 22A. The stator 22A also includes a set of stacked equally distantly spaced apart annularly shaped three phase electromagnetic stator coils or windings, such as coils 28A, 29A, 30A and 31A (FIG. 20). The ring-shaped coils are mounted in a set of open slots in the stator core 94A such as the slots 32A–35A (FIGS. 19 and 20), in order to maximally utilize the iron and copper volume in the stator 22A. The coils in the stator core, coact electromagnetically with the permanent magnets mounted on the mover 20A to cause the mover 20A to move reciprocatively rectilinearly within the motor housing 21A and the stator 22A. In this regard, when the coils are electrically energized with an electrical current by the motor controller 400A, a set of magnetic fields are established to induce motional voltages in the three phase stator windings and in the stator core 94A. FIG. 33 is a partial diagrammatic and schematic representation of the stator core 94A and the windings arranged in a set of phase groups 602A, 604A and 606A relative to their slot locations such as $A_1A$, $B_{3A}$ and $C_2A$ for example, in the stator core 94A.

Figure 30:
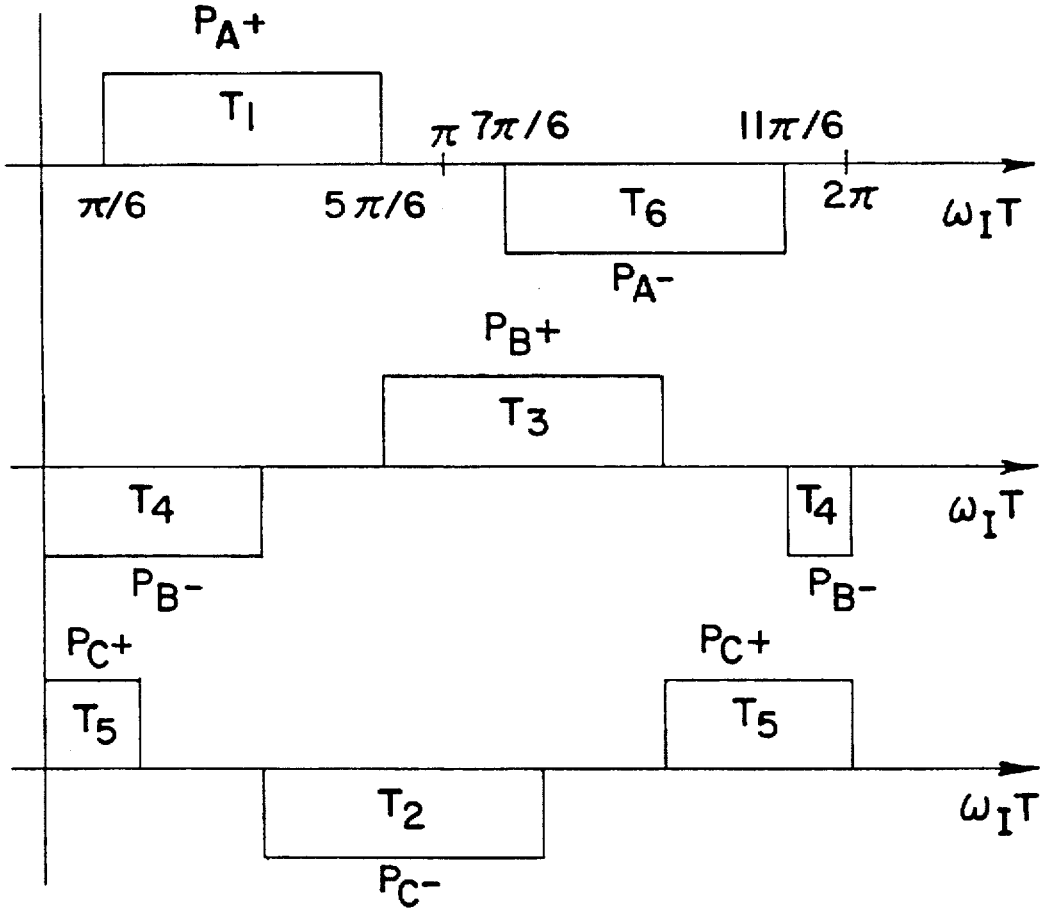
FIG. 30 is a phase diagram illustrating the on-off states of the transducer transistors of FIG. 28 for forward motion of the mover.
Figure 31:
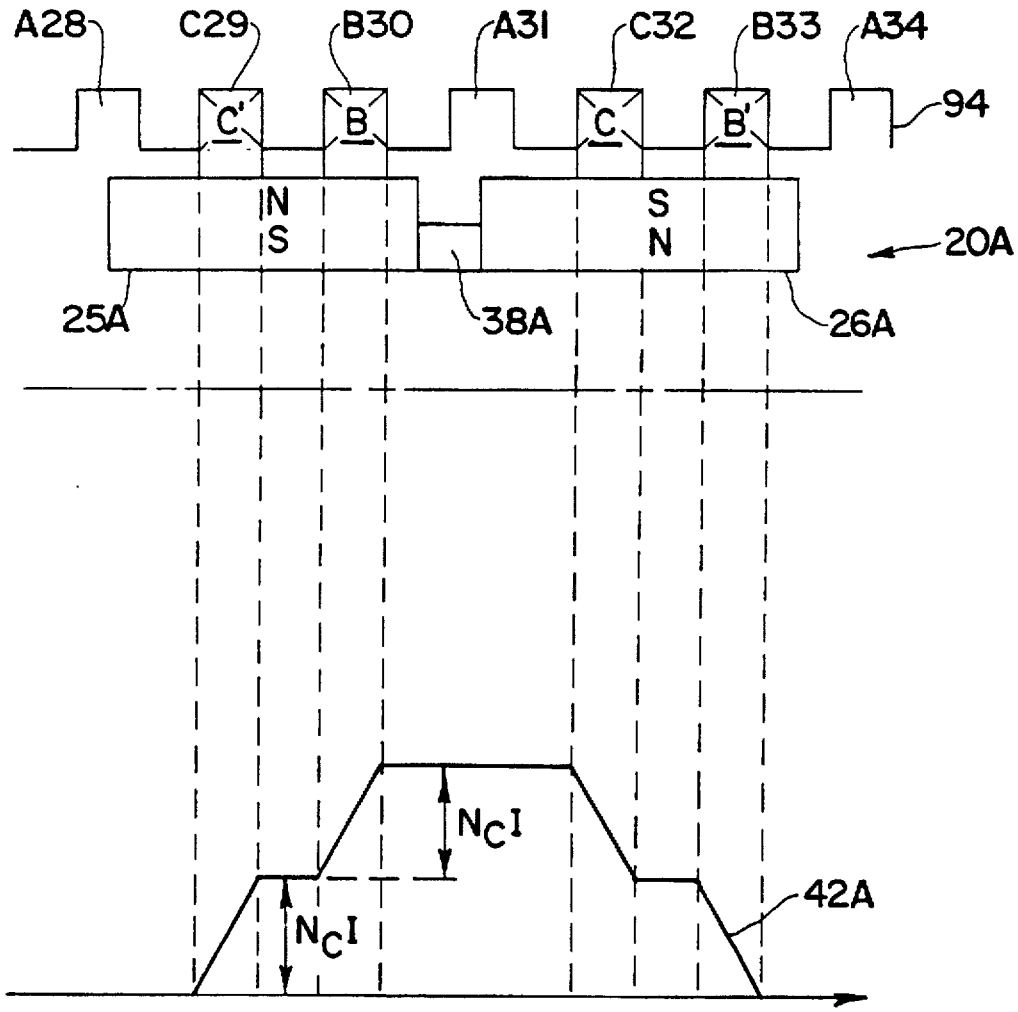
FIG. 31 is a mmf diagram illustrating phase b and c conduction in the motor assembly of FIG. 13.

In operation, the controller 400A sends generally rectangular phase pulses of electric current (FIG. 30) to the stator coils, such as the coils 28A–31A, causing the coils to be magnetized with alternate north and south poles. Reversing the current, as shown in FIG. 30, reverses the sequence of the poles. Thus, when the fields produced in the coils 28A–31A cause their poles to be out of alignment with the poles on the actuator 20A, the actuator 20A under the influence of magneto motive forces (mmf) moves to position the poles so they oppose each other. The motor controller 400A causes the current sent to the coils 28A–31A to be reversed to change the poles so that actuator 20A moves to follow them. FIG. 31 is a diagrammatic illustration showing the magneto motive forces, shown generally at 42A, induces in two phase conduction, as the phase current pulses energize coils 29A–30A and 32A–33A respectively for co-acting with magnets 25A and 26A.

In order to permit the transportation of the well fluids 12A to the surface 12AA, the oil well includes a casing 15A having a set of interconnected production tubes or tubings 15AA disposed therein. As best seen in FIGS. 13 and 14, the production tubing 15AA terminates downhole in a downhole cartridge sleeve assembly 17A having a containment tube 18A adapted to be coupled to the production tube 15AA for directing well fluids therein and a sealing seat 19A (FIG. 14) which is adapted to receive and support the motor-pump cartridge unit 10A in a stationary downhole position within the hollow interior of the tube 18A for fluid pumping purposes. In this regard, the sealing seat 19A includes a centrally disposed hole or opening 19AA that permits well fluids 12A to enter the motor-pump cartridge unit 10A for pumping the well fluids 12A to the surface 12AA. A control cable 16A attached to above ground means (not shown) is disposed within the hollow interior of the producing tubing 15AA and is attachable to one end of the motor-pump cartridge unit 10A for the purpose of permitting the unit 10A to be raised or lowered within the tubing 15AA to help facilitate the repair or replacement of either the linear motor assembly 11A or the sucker rod pump 13A. The pump control system 9A and sleeve assembly 17A are more fully described in copending U.S. Pat. No. 5,049,046 mentioned above.

In operation, the motor pump cartridge unit 10A is lowered by the control cable 16A into the oil well through the production tubing 15AA. The cartridge unit 10A is received within the cartridge sleeve assembly 17A which secures removably the cartridge unit 17A within the centrally disposed sealing seat 19A. In this regard, when the cartridge unit 10A is received within the interior of the cartridge sleeve assembly 17A, the seat 19A matingly engages and supports the cartridge unit 10A. In this regard, a substantially fluid tight seal is formed between the cartridge unit 10A and the seat 19A of the cartridge sleeve assembly 17A, with the cooperation of the static head of the fluid 12A within the production tubing 15AA. Power is then applied to the motor assembly 11A via the control cable 16A to initiate a fluid pumping action. In this regard, the seat 19A serves as a fulcrum so that fluids in the well may be discharged from the motor pump cartridge unit 10A into the containment tube 18A and thence upwardly into the production tubing 15AA for transportation to the surface 12AA.

Considering now the motor controller 400A, in greater detail with reference to FIGS. 13 and 16, the motor controller 400A is electrically connected to the stator 22A for sending electric current to the electromagnetic coils mounted therein for controlling the motor current levels to provide hysteresis control. The motor controller 400A includes a surface motor pulse control assembly 500A and a downhole motor control electronic unit 600A (FIG. 14) for controlling the operation of the downhole motor pump cartridge unit 10A. The surface motor pulse control assembly 500A is interconnected to the downhole motor control unit 600A by the cable 16A. The control unit 600A is interconnected to the stator windings or coils through a conductor cable shown generally at 112A (FIGS. 19, 22 and 24).

Figure 27:
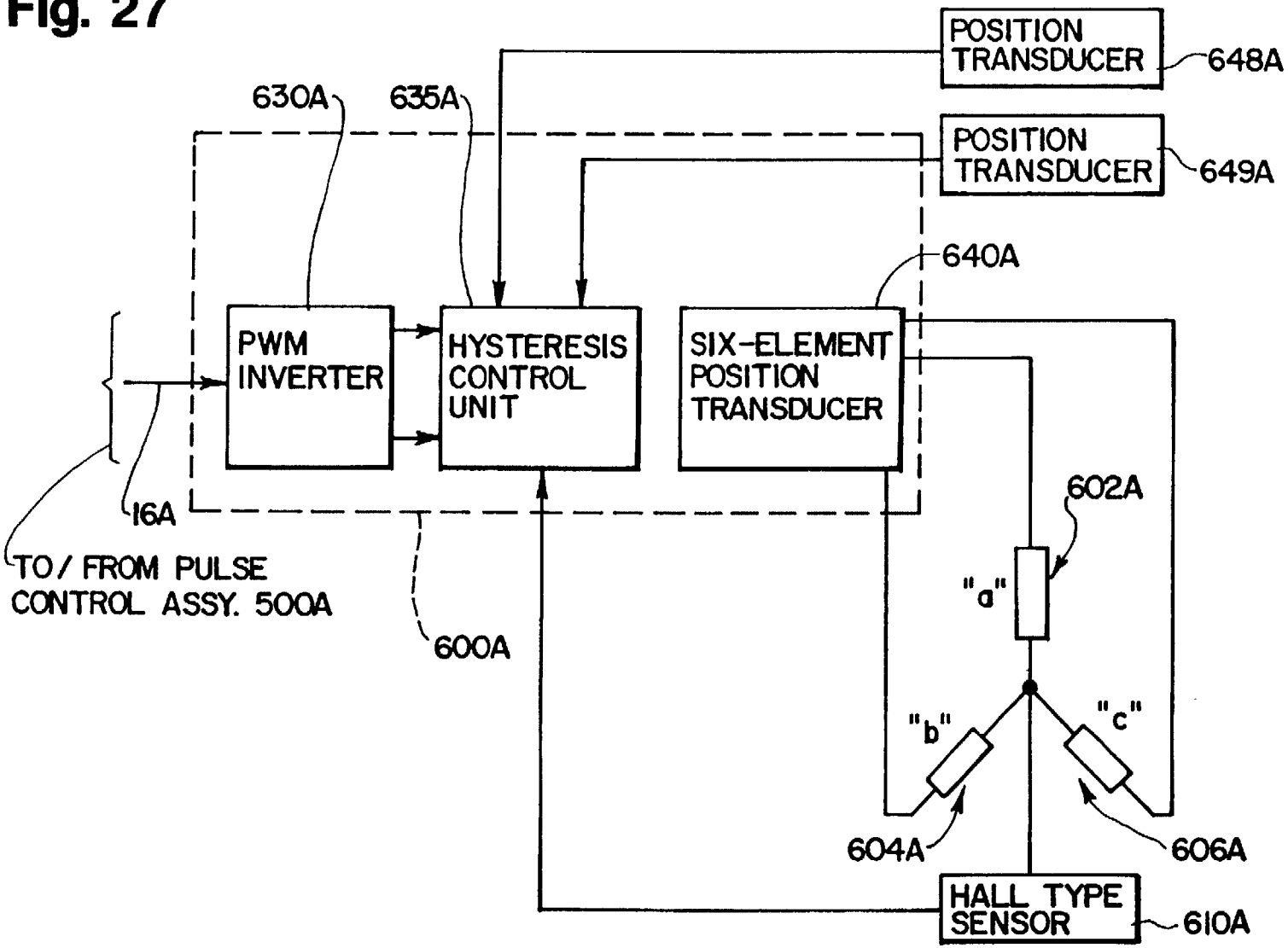
FIG. 27 is a block diagram of a motor control unit of FIG. 13.

As will be explained hereinafter in greater detail, the stator coils are arranged in phase groupings shown generally at 602A, 604A and 606A (FIG. 33). The phase groupings 602A, 604A and 606A are interconnected at one of their terminal ends through a common node connector 608A which in turn is coupled to the motor control unit 600A through a Hall type sensor 610A (FIG. 27). The sensor 610A is a six elements per pole pair position sensor. The other terminal ends of the phase groupings 602A, 604A and 606A are individually connected to the motor control unit 600A via the conductor cable 112A through conductors 612A–614A respectively.

In order to provide a passageway for the cable 112A between the motor control unit 600A and the stator coil groupings 602A, 604A and 606A, the stator core 94A includes a groove or slot 110A (FIGS. 22 and 23) that permits the passage of the cable connectors 612A–614A as well as other control wires.

Figure 22:
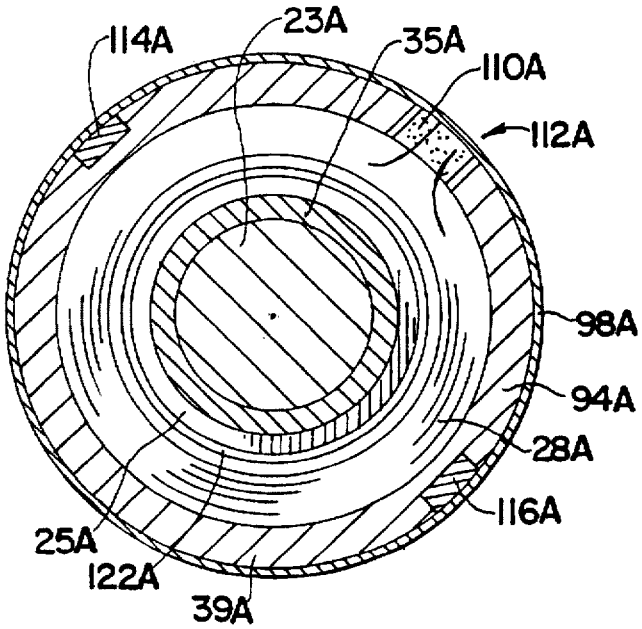
FIG. 22 is a transverse cross sectional view of the stator and mover of FIG. 20 taken substantially along lines 10—10.
Figure 23:
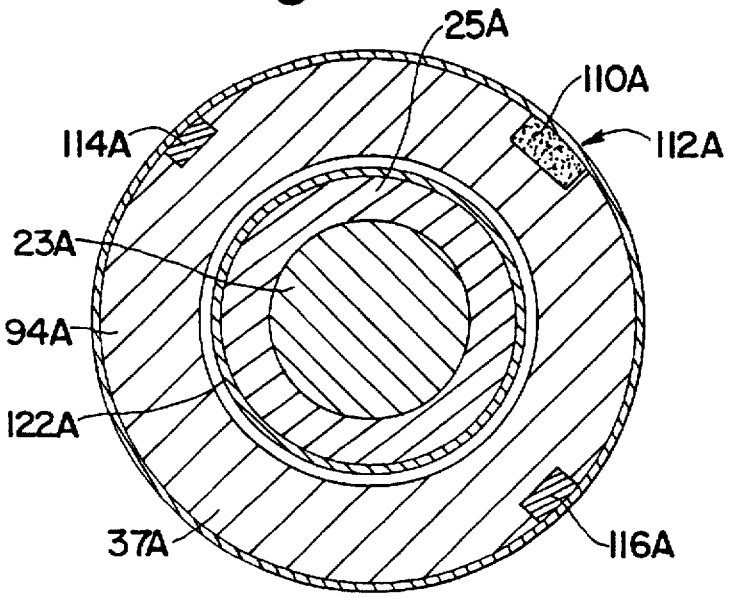
FIG. 23 is a transverse cross sectional view of the stator and mover of FIG. 20 taken substantially along lines 11—11.
Figure 25:
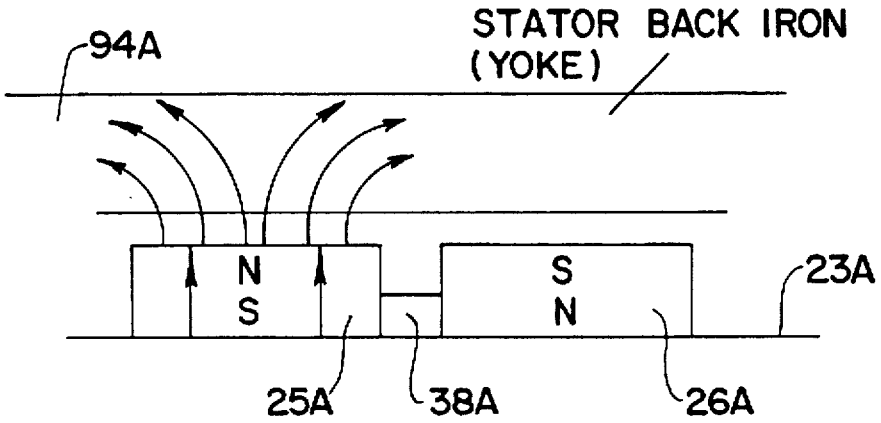
FIG. 25 is a diagrammatic view of the stator core of FIG. 20 illustrating the black iron core flux lines over the length of a mover magnet.
Figure 26:
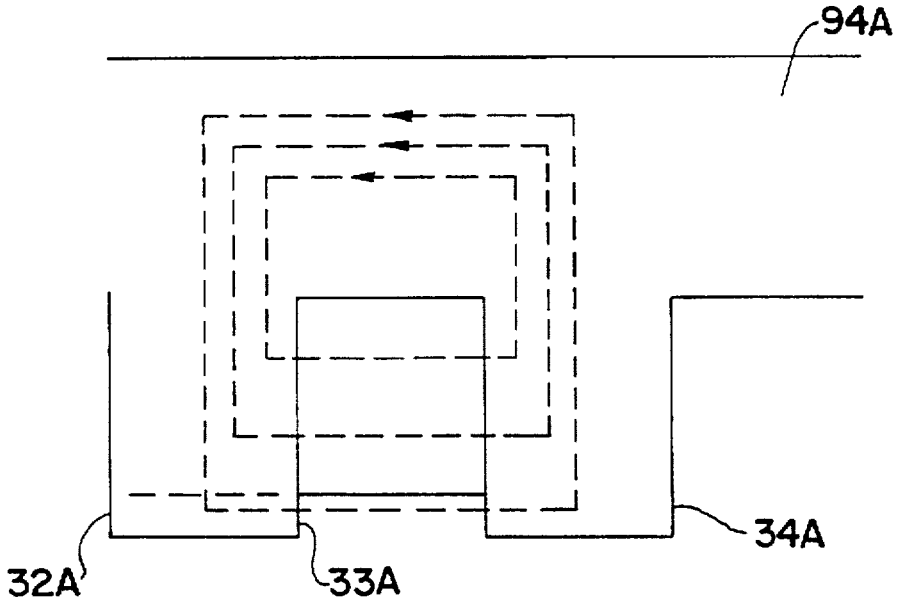
FIG. 26 is another diagrammatic view of the stator core of FIG. 20, illustrating slot leakage.

As will be explained hereinafter in greater detail, the coils, such as coils 28A–31A are separated one from another by a plurality of sections of laminated material configured in large circular laminations such as lamination 37A (FIG. 23) and smaller circular laminations such as a lamination 39A (FIG. 22). The laminated sections when secured together form a series of slots shown generally at 620A, including slots 32A–35A (FIG. 33) to help concentrate the magnetic flux from each coil and to oriented the flux of each coil in a general horizontal direction as shown diagrammatically in FIGS. 25 and 26.

In order to avoid the possibility of mechanical contact between the coils on the stator 22A and the moving magnets on the mover 20A, a magnetic air gap, shown generally at 120A (FIG. 20) is formed between the stator core 94A and the mover 20A. The air gap 120A between the stator core 94A and the mover 20A is sufficiently large to permit a thin protective coating (not shown) to be applied to the stator bore to avoid corrosion. In this regard, the distance between the coils on the stator 22A and the magnets on the mover 20A is between about 0.70 mm and about 0.108 mm. A more preferred distance is about 0.80 and about 0.98 mm, and a most preferred distance is about 0.94 mm. The preferred stator bore coating is a good electrical and magnetic insulator that is able to withstand temperatures up to about 125° C.

Considering the motor housing 21A in greater detail with reference to FIGS. 14 and 16–19, the motor housing 21A comprises a pair of spaced-apart housing spacers 60A, 62A, a pair of spaced-apart end bells 64A, 66A, and a cable housing 68A.

In order to permit the motor assembly 11A to be transported in the small diameter production tubing 15AA, the housing spacers 60A, 62A and the end bells 64A, 66A are generally annularly shaped hollow cylinders adapted to receive within their hollow interiors, the mover 20A. The housing spacers 60A, 62A and the end bells 64A, 66A are coupled together with the cable housing assembly 68A and stator 22A to form the motor housing 21A.

As noted earlier, the motor assembly 11A is a nonsalient pole synchronous machine with a large magnetic airgap between the mover 20A and the stator 22A. The mover 20A and the stator 22A are constructed to cooperate together to develop a sufficient amount of thrust in a short stroking distance, to effectively and efficiently remove well fluids from downhole to the ground surface. In this regard, the stroking distance is defined along a longitudinal path extending along a path in the cable housing 68A, the housing spacers 60A, 62A, and the end bells 64A, 66A.

As noted earlier, the motor housing 21A helps define a path of travel for the mover 20A. In this regard, the mover 20A travels along the path of travel in a reciprocative manner defining a stroking distance for the mover 20A to actuate the sucker rod pump 13A (FIG. 14). In the preferred embodiment of the present invention, the stroking distance traveled by mover 20A is about 30A feet for developing about 500A pounds of thrust. It will be understood by those skilled in the art, that other stroking distances are possible depending upon the amount of thrust to be developed by the motor 11A and its duty cycle operation. Table I is examples of the thrust per stator sector that may be developed depending on the duty cycle of the motor.

TABLE II

| DUTY CYCLE | THRUST PER SECTOR |
|---|---|
| CONTINUOUS | 25 pounds |
| 66% | 33 pounds |
| 33% | 50 pounds |

Considering now the cable housing assembly 68A in greater detail with reference to FIGS. 14 and 16, the cable housing assembly 68A generally includes a hollow generally conical top portion 71A for helping to guide the cartridge unit 10A in the production tubing 15AA and to guide the oil discharge from the pump 13A into the production tubing 15AA. The top portion 71A includes an integrally connected generally cylindrical downwardly depending threaded skirt portion 72A (FIG. 16) having a set of threads 73A for threadably connecting the cable housing assembly 68A to the end bell 64A. The cable housing assembly 68A also includes a cable terminator shown generally at 74A, for attaching the cable 16A to the motor control unit 600A.

Considering now the cable terminator 74A in greater detail with reference to FIG. 16, the cable terminator 74A includes a generally conically shaped retainer 84A for engaging an internal taper shoulder 85A converging radially outward from a cable opening to capture the retainer therewithin. The cable 16A passes through the opening and is centrally disposed on the top portion 71A and is connected through the retainer 84A by means (not shown). The motor control unit 600A is disposed directly below the retainer 84A and is supported thereby so that the electrical conductor disposed between the control unit 600A and the motor controller 500A are not stressed when the cartridge unit 10A is raised and lowered in the production tubing 15AA.

Figure 17:
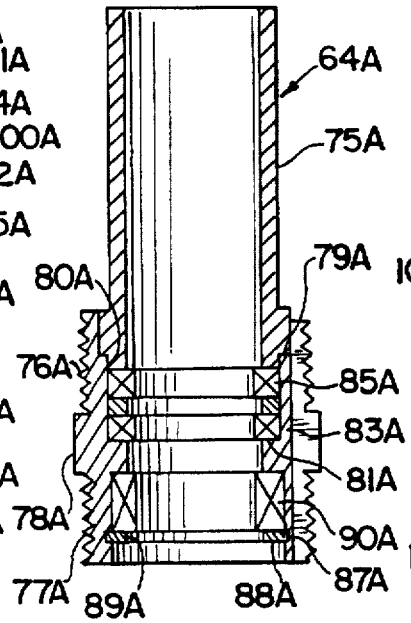
FIG. 17 is a cross sectional view of a cable housing unit forming part of the linear d.c. motor assembly of FIG. 16.

Considering now the end bells 64A and 66A in greater detail with reference to FIGS. 14, 16 and 17, the end bell 64A is dimensioned for coupling the cable housing 68A to the housing spacer 60A. End bell 66A is similarly dimensioned for coupling the housing spacer 62A to the sucker rod pump 13A. As end bell 66A is substantially similar to end bell 64A only end bell 64A will be described hereinafter in greater detail.

Considering now the end bell 64A in greater detail with reference to FIGS. 14, 16 and 17, the end bell 64A is generally cylindrically shaped having a pair of threaded wall portions 76A and 77A disposed between an integrally connected annular wall portion 78A. The threaded wall portion 76A is adapted to threadably engage the threaded skirt portion 72A of the cable housing 68A for coupling the cable housing 68A to the end bell 64A. Similarly, the wall portion 77A is adapted to threadably engage a threaded end portion 52A of the housing spacer 60A for coupling the end ball 64A to the housing spacer 60A.

The wall portion 76A includes an annular shoulder 79A which is adapted to matingly engage and support a centrally disposed receiving tube 75A. A lower end portion of the tube 75A includes a threaded section that is adapted to threadably engage a set of internal threads 80A disposed on the interior portion of wall 76A. As best seen in FIG. 16, the tube 75A, extends upwardly from the shoulder 79A and is received within the hollow interior of the cable housing 68A. The conductor tube 75A is dimensioned a sufficient width to receive within its interior an upper end portion of the mover 20A so that a constant internal volume is maintained within the interior of the motor 11A. The tube 75A, thus permits the conductors within the cable 112A to pass through the assembly 68A to the stator 22A without coming into engagement with the mover 20A. The annular wall portion 78A also includes an annular interior shoulder 81A for engaging and supporting sealing assembly including a quad ring seal 83A and a cooperating quad ring wiper 85A. In this regard the sealing assembly is disposed between the shoulder 81A and the lower terminal end of the tube 75A for helping to prevent lubrication oil within the stator 22A from entering the hollow interior of the cable housing 68A.

The wall portion 77A includes a groove 87A that is adapted to engage and support a retaining clip 88A for supporting an annular shaped bearing 90A disposed between the clip 88A and the shoulder 81A. The clip 88A has an inner annular opening 89A that is sufficiently large to permit the mover 20A to pass therethrough to permit unimpeded rectilinear movement of the mover 20A through the end bell 64A along its path of travel.

Considering now the housing spacers 60A and 62A in greater detail with reference to FIGS. 16 and 18, the housing spacers 60A and 62A are substantially identical so only housing spacer 60A will be described hereinafter in greater detail.

Figure 18:
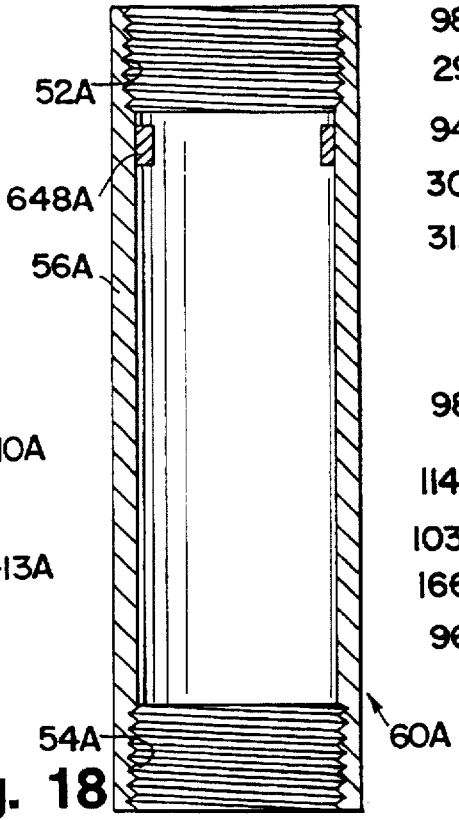
FIG. 18 is a cross sectional view of a housing section of the linear d.c. motor assembly of FIG. 16.

Considering now the housing spacer 60A in greater detail with reference to FIG. 18, the housing spacer 60A is a hollow elongated cylindrically shaped tube having an annular wall portion 56A having a pair of internally threaded end portions 52A and 54A. The threaded end portion 52A is adapted to threadably receive and engage the threaded wall portion 77A of the end bell 64A. In a similar manner, as best seen in FIG. 14, the threaded end portion 54A is adapted to threadably receive and engage the stator 22A as will be explained hereinafter in greater detail. An annular shaped position transducer 648A is mounted (by means not shown) within the hollow interior of the housing spacer 60A for sensing the position of the mover 20A as it moves within the spacer 60A. A similar position transducer 649A is mounted in housing spacer 62A.

Considering now the stator 22A in greater detail with reference to FIGS. 16–23, the stator 22A is generally an elongated hollow cylindrical tube having a central core portion 94A disposed between a pair of spaced apart threaded end portions 92A and 96A respectively. The threaded end portions 92A and 96A include a pair of internally disposed annular grooves 162A and 166A respectively which are adapted to receive and support therein a pair of retaining clips 163A and 167A respectively. As will be explained hereinafter in greater detail, the retaining clips are used to retain a pair of bearings 101A and 103A respectively within the hollow interior of the stator 22A to help enable unimpeded movement of the mover 20A through the stator 22A. The threaded end portions 92A and 96A are adapted to be received within and threadably engage the housing spacer 60A and 62A respectively. An annular sheath 98A surrounds the central core 94A. As will be explained hereinafter in greater detail the stator core 94A is constructed on a section by section basis and is dimensioned to accommodate a given number of stator core windings, such as at least forty-eight stator core windings. The core windings are divided into the phase groupings 602A, 604A and 606A. In this regard, the phase grouping 602A includes coil windings with designed locations shown generally at A1A, A4A, A7A, A10A, A13A, A16A, A19A, A22A, A25A, A28A, A31A, A34A, A37A, A40A, A43A, and A46A; phase grouping 604A includes coil windings with designated locations shown generally at B3A, B6A, B9A, B12A, B15A, B18A, B21A, B24A, B27A, B30A, B33A, B36A, B39A, B42A, B45A and B48A; and phase grouping 606A include coil windings with designated locations shown generally at C2A, C5A, C11A, C14A, C17A, C23A, C26A, C29A, C32A, C35A, C38A, C41A, C44A and C47A.

As best seen in FIG. 33, the designated locations correspond to designated stator core slots locations 1A–48A. In this regard for example, coil 28A is disposed phase grouping 602A at designated location A28A, coil 29A is disposed in phase grouping 606A at designated location C29A and coil 30A is disposed in phase grouping 604A at designated location B30A.

As best seen in FIG. 19, the threaded end portion 92A includes an internal bore 93A which terminates in a shoulder 95A defining an opening to an annular bore 104A within the core 94A. The bore 104A is dimensioned for receiving the mover 20A therein. The threaded end portion 96A includes a like-dimensioned internal bore 97A which terminates in a shoulder 99A also defining another opening to the bore 104A.

In order to help facilitate the unimpeded movement of the actuator 20A within the hollow center of the stator 22A, the bearings 101A and 103A, are mounted spaced apart within the stator 22A. The bearing 101A is mounted between shoulder 95A and the retaining clips 163A, while the bearing 103A is mounted between shoulder 99A and the retaining clip 167A.

Considering now the linear motor 11A in still greater detail, given the small inner diameter of the production tubing 15AA, a tubular structure is the most appropriate choice for the stator 22A. In this regard, in order to maximize utilization of the iron and copper volume, the annularly-shaped electromagnetic stator coils, such as the coils 28A–31A, are placed in the spaced apart open slots, such as the slots 32A–35A. The slots 32A–35A are disposed along the longitudinal axis of the core 94A. Consequently, no end connections of the windings exist, and the entire amount of copper (in the slots) is useful for electromagnetic purposes.

The actuator 20A, with its ring-shaped permanent magnets, such as magnets 24A–27A, mounted thereon, induce motional voltages as the actuator 20A moves within the hollow interior of the stator 22A. In this regard, the motional voltages are induced in the 3-phase stator windings and in the stator core 94A. Also, hysteresis and eddy-current losses are produced in the core 94A. The magnets, such as magnets 24A–27A are composed of rare-earth Samarium-Cobalt ($SmCo_5$) and exhibit a demagnetization characteristic as shown by the line 40A in FIG. 32. Such a coordinate axis plot of the characteristics of a magnet are well known.

The hysteresis and eddy-current core losses depend on the core flux density, which is fairly high to reduce the core volume, and the on frequency of the motor 11A. In this regard, the on frequency $f_{1A}$ is dependent on the synchronous speed of the motor us, and the stator winding pole pitch, $\tau$, as defined by equation (1):

$$f_1 = \frac{u_s}{2\tau} \tag{8}$$

In order to reduce the black-iron core height both in the secondary and in the primary (or stator) because of the small external diameter of the stator 22A, the pole pitch is reduced to a mechanically feasible minimum value of $\tau$=3 cm (or 1.18 in). This minimum value is directly dependent upon the internal diameter of the production tube 15AA. From equation (1) it follows that such a small pole-pitch will increase the frequency $f_{1A}$ and thereby result in core losses. The operating frequency, from equation (1) is then given as follows:

$$f_1 = \frac{0.2159}{2(0.03)} = 3.5983 = 3.6\ \text{Hz} \tag{9}$$

The travel time, $t_r$, over the stroke length of a single sector of the motor 11A at a constant speed is given by equation (3):

$$t_r = \frac{\text{stroke length}}{\text{speed}} = \frac{24.5\ \text{inches}}{8.5\ \text{inches/s}} = 2.882\ \text{s} \tag{10}$$

It follows from equations (25) and (26) that the current and the flux in the motor requires approximately $t_1 f1$= 2.882×3.6=10.37 periods over the travel along one sector stroke length.

The low-frequency operation of 3.6 Hz in the motor 11A is a great benefit, as the core losses are low, although the permanent magnet flux density is rather high. In order to reduce core volume, the core flux density is also considerably high. At such a low frequency (of 3.6 Hz) the depth of penetration of the flux in the iron is given by $$\begin{aligned} \delta_{iron} &= \sqrt{(2/\mu_i \omega \sigma_i)} \\ &= \sqrt{(2/200 \times 4\pi \times 10^{-7} \times 2\pi \times 3.6 \times 5 \times 10^6)} \\ &= 8.39 \times 10^{-3}\ \text{m} - 8.39\ \text{mm} \end{aligned} \tag{11}$$

As will be shown hereinafter later, the slot depth is about 4.5 mm, which compares with $\beta_{iron}$ obtained in equation (27) for a high degree of saturation ($\mu_i$=200$\mu_o$). However, to be able to use a stator core, such as the stator core 94A, the "apparent" conductivity, $\delta_i$, of the iron must be reduced. To accomplish such a reduction, the core 94A is laminated, so the coils, such as coils 28A–31A may be inserted in the slots 32A–35A, respectively without splitting the stator core 94A into two halves, which would otherwise be required to reduce the core losses. This technique permits the entire core 94A to be built on a tooth-by-tooth basis after inserting the coils, such as the coils 28A–31A in the slots of the stator, such as slots 32A–35A. Such a laminated structure produces low core losses. Moreover, as the laminations are circular or annular in structure, at least in the back-iron leakage fluxes traverse the space between the laminations.

In order to secure the ring shaped laminations forming the core 94A together, a pair of oppositely disposed solid iron lamination holders or rods 114A and 116A (FIG. 23) extend along the entire outer peripheral longitudinal axis of the core 94A. The rods 114A and 116A enable the core laminations to be secured together and assembled on a sector by sector basis to form the core 94A.

Considering now the mover 20A in greater detail with reference to FIGS. 20–23, the permanent magnets, such as magnets 24A–27A mounted on the shaft 23A are interleaved with the low reluctance spacers, such as the spacers 36A–39A. The magnets, such as magnets 24A–27A are coated with a thin coat of high toughness, material shown generally at 122A, such as nonmagnetic stainless steel to help reduce mechanical failures of the magnets. A nonmagnetic thin stainless steel sleeve is preferred. A preferred thickness of the sleeve is about 0.1 mm to about 0.2 mm, while a most preferred thickness is about 0.15 mm.

As a single-layer stator winding having 1 slot/pole/phase (q=1) is preferred, a trapezoidal mmf distribution will be produced as a result of the coils being energized with current pulses having a general rectangular shape. Also, because the permanent magnets, such as magnets 24A–27A produce (approximately) a trapezoidal airgap flux density, a 120° rectangular current control circuit is necessary to reduce the thrust pulsations. In this regard, where there is an instantaneous commutation, only two of the three phases will be conducting at any given time. FIG. 30 illustrates the ideal rectangular current waveform in each of the three phases, phase a ($P_a$), phase b ($P_b$) and phase c ($P_c$) where only two phases conduct at any given time. The armature mmfs for such a two-phase rectangular current control are shown in FIG. 31, where the mmfs for phases b and c of motor assembly 11A are illustrated generally at 42A.

From the foregoing the thrust developed by the motor is given by the following equation:

$$F_x = B_g \times 2 \times 2N_i(\pi D_{si}) \quad (12)$$
$$= .6 \times 2\ 2N_i\pi \times D_{si}$$

where $D_{si}$ is the stator bore diameter

Assuming a small bore of approximately 29 mm to allow transportation of the motor assembly 11A through the production tube 15AA, the total thrust ($F_x$) equals about 0.2194 $N_i$ are determined by choosing a design current density $J_{co}$ at the rms phase current relative to the number of pulse-pairs. In this regard, as the pole-pitch and slot-pitch are known; the phase compare turns can be calculated as follows:

$$N_i = p\ q\ nc \quad (13)$$

where p=number of pole-pairs;

q=slots/pole/phase=1; and nc=the number of conductors/slot.

Assuming a gap of 5 slot-pitches (or $S_x10$=50 mm) every 0.48 m (or 16 poles) of stator stack length to install the bearings, the total stator length may be easily calculated by those skilled in the art. A preferred value for $n_c i$ is about $9\times10^{-6}\times7.389\times10^{6}$ or 66.5 ampere-turns to produce a desire thrust.

From the desired thrust, the overall motor length is determined to be about 10.2 meters for about 154 pole pairs. However, in order to utilize a single Hall-type six-element position transducer, a more preferred number of pole pairs is about 160 distributed over 20 sections where the distance between the first slots of the neighboring sections is as close to 2T or about 0.06 meters. Thus, surface permanent magnetics have a preferred length of about 25 mm to reduce the thrust pulsations and develop the desired thrust. As the field due to the armature mmf is much lower than the permanent magnet field, the armature mmf will not affect significantly the stator teeth saturation.

Figure 32:
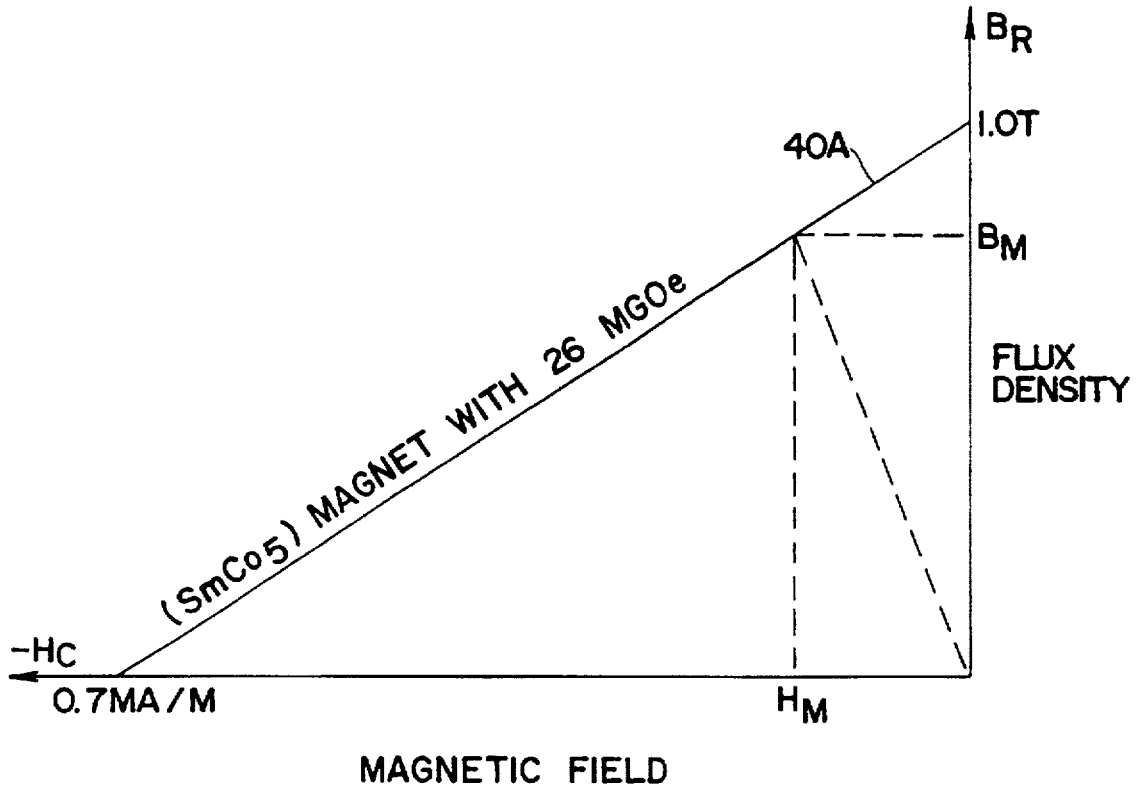
FIG. 32 is a coordinate representation of the demagnetization characteristic of an individual permanent magnet of FIG. 20.

A preferred material for the permanent magnets is Samarium-cobalt (Sm $Co_5$) or a similar type material. For such a magnet $B_r$=1.02T and $H_c$=0.732MA/m at 26 MGOe as shown in FIG. 32. With a high $B_{go}$ (close to $B_r$), the thickness of the magnets increases, and thus teeth become thicker and slots thinner to reduce saturation. In such a situation, if the slot depth remains unchanged, the coreback-iron remains fixed for a given stator external diameter. It should be noted however, with a larger airgap, flux density saturation of the stator 22A and the mover core back-irons increase appreciably. Therefore there will be a degradation in the performance of the motor. Therefore to achieve an improved efficiency, the ring height of the permanent magnets is chosen by selecting $B_g$=0.6T, with $B_r$=1.0T and $H_c$=0.7 MA/M.

In order to help avoid excessive magnetic saturation and to provide mechanical strength to the actuator 20A, the actuator shaft 23A should be composed of a heat tolerant material.

Table II–VI provide respectively the preferred dimensions for the stator core 94A, the mover shaft 23A, the mover magnets, such as magnets 24A–27A and the low reluctance spacers, such as spacers 36A–39A for a small diameter motor capable of being mounted within a production tube having an outside diameter of about 2 inches.

TABLE III

| STATOR CORE | |
|---|---|
| length = | 485 mm |
| outer diameter = | 47 mm |
| bore = | 29 mm |
| slot opening = | 5 mm |
| slot depth = | 5 mm |
| tooth width = | 5 mm |
| tooth pitch = | 10 mm |
| number of slots = | 48 |
| lamination thickness = | 0.5 mm |
| material: | magnetic steel |

TABLE IV

| MOVER CORE | |
|---|---|
| length = | 1400 mm |
| diameter = | 18 mm |
| material: | solid iron |

TABLE V

| MAGNETS | |
|---|---|
| Ring-shaped Samarium-cobalt rare-earth | |
| outer diameter = | 27 mm |
| inner diameter = | 18 mm |
| length = | 25 mm |

Magnets to be coated with a tough non-magnetic conducting 0.1 to 0.2 mm thick-coating (or a 0.1 mm thick stainless steel sleeve over the magnets may be used).

TABLE VI

| SPACERS | |
|---|---|
| low reluctance ring-shaped | |
| length = | 5 min |
| outer diameter = | 27 mm |
| inner diameter = | 18 mm |

Considering now the surface motor pulse control assembly 500A in greater detail with reference to FIG. 13, the pulse control assembly 500A sends high voltage direct current pulses downhole for use by the motor control unit 600A to control the sequencing of the pulses to the stator winding group 602A, 604A and 606A. The pulse control assembly 500A is more fully described in copending U.S. Pat. No. 5,049,046.

Considering now the motor control unit 600A in greater detail with reference to FIG. 27, the motor control unit 600A is a rectangular current control on-off controller. As best seen in FIG. 27 the control unit 600A includes a pulse width modulated (PWM) transistor inverter 630A which is coupled to the pulse control assembly 500A via the cable 16A. The invertor 630A is a bipositional switch turned on by the signals supplied by the pulse control assembly 600A and has a 5 KHz switching frequency. The invertor 630A includes a power transistor 632A (FIG. 28) and a protective or braking resistor 634A. The transistor 632A is a 5 ampere, 1000 volt power transistor.

The control unit 600A also includes a current hysteresis or ramp control unit 635A coupled between the invertor 630A and a six-element per pole pitch position transducer 640A for the commutation of the phases in the invertor 630A. The transducer 640A includes a set of six transistor elements 642A–647A (T1A–T6A) to provide a 120° conducting period. The elements of the transducer 640A are shifted to provide three phase commutation and only two transistor elements, such as transistors 642A and 643A, conduct at any one time. The transducer 640A also includes a filter capacitor (not shown) and a set of diodes 652A–657A that provide a charging path to the charging capacitor.

The position sensor 640A (P) is connected to the individual transistors 642A–647A via the hysteresis control unit 635A to provide the positive and negative voltages in the three phases. For example, the position sensors P–T and P–$T_6$ produce, respectively, positive and negative voltages (currents) in a first phase "a"; P–$T_3$ and P–$T_4$ in a second phase "b"; and P–$T_5$ and P–$T_2$ in a third phase "c". Thus, the stator mmf jumps every 60° as best seen in FIG. 30.

The position sensor element (not shown) which energizes transistor 642A ($T_1$) is located 90° behind the axis of phase "a" with respect to the direction of the mover 20A motion. In this regard, the power angle in the motor assembly 17A varies from 60° to 120°, with an average of 90°.

Figure 29:
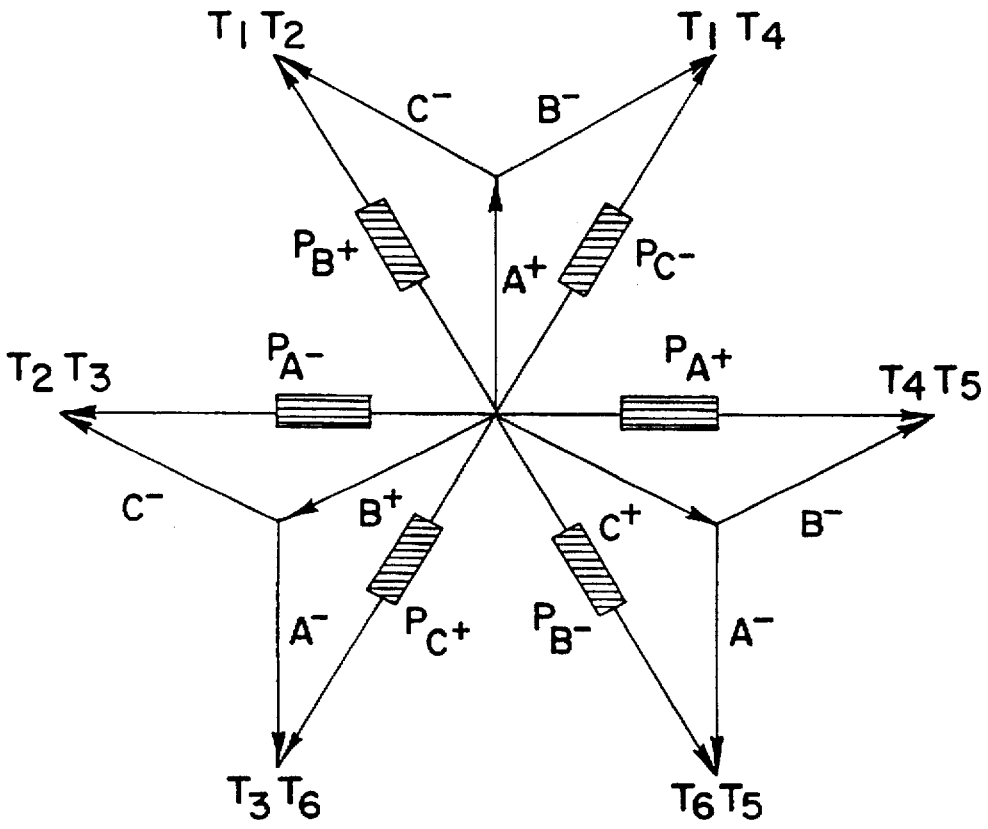
FIG. 29 is a diagrammatic representation of position transducer element locations relative to the stator phases axis of the stator of FIG. 13.

To reverse the direction of the mover 20A, the power angle is reversed by 180°. In this regard, the switching of the transistors 642A–647A turned on and off by the position transducer 640A is switched by 180°. The command for speed reversal is produced by a proximity transducer having two parts shown generally at 648A and 649A respectively. In this regard, the proximity transducer 648A and 649A generates a signal whenever regenerative braking and speed reversal is to begin. Thus, the output signals change as follows: $a+\rightarrow a^-$; $b^+\rightarrow b^-$; and $c^+\rightarrow c^-$, and vice versa. FIG. 29 shows diagrammatically the position transducer element locations with respect to stator phase axes.

Figure 28:
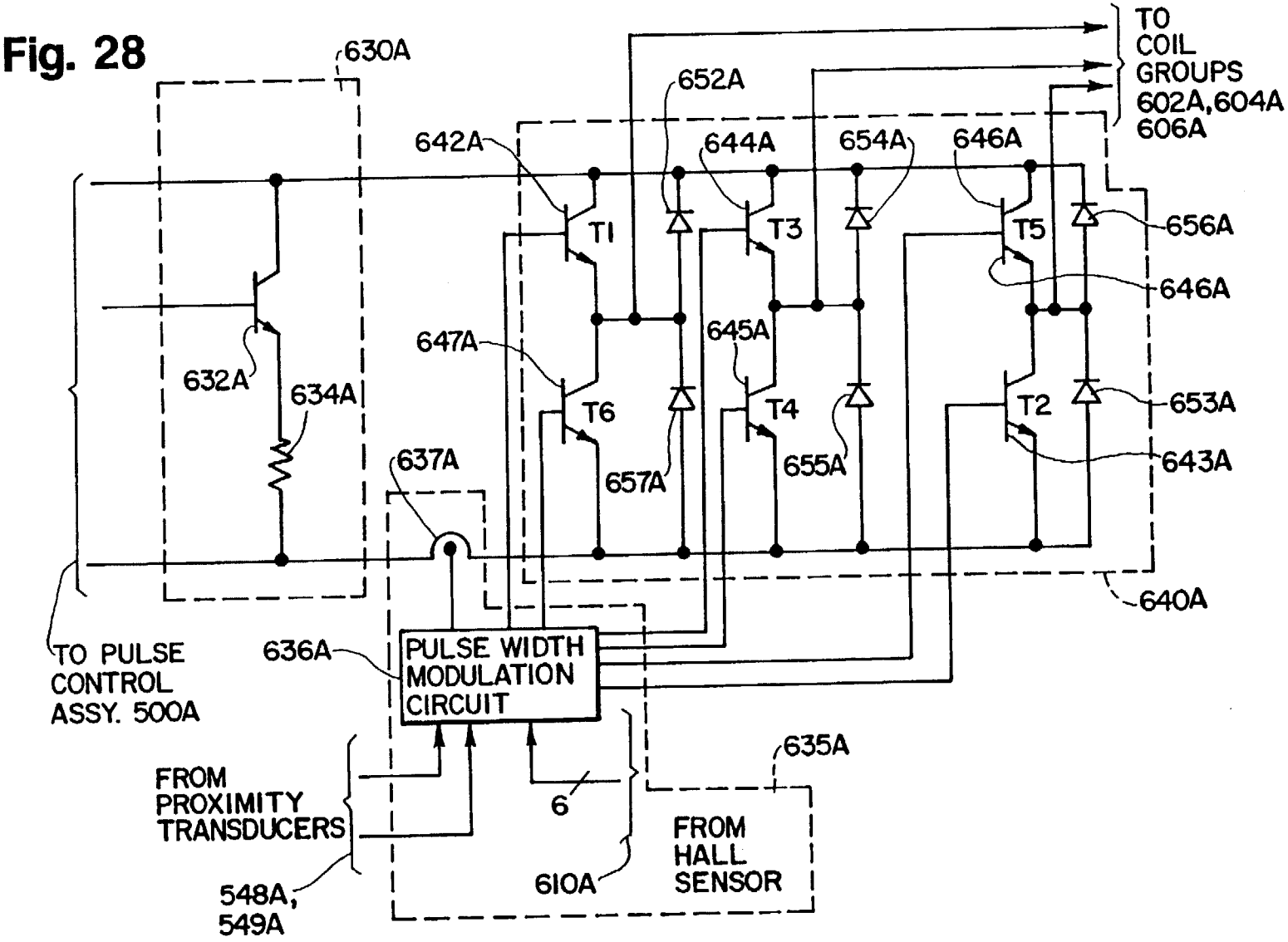
FIG. 28 is a schematic diagram of a pulse width modulated invertor and a hysteresis control unit forming part of the motor control unit of FIG. 13.

Considering now the hysteresis control unit 635A in greater detail with reference to FIG. 28, the hysteresis control unit 635A includes a conventional pulse width modulator circuit 636A and hall type current sensor 637A. The hall type current sensor 637A is coupled between the inverter 630A and the position transducer 640A for sensing the flow of current between the inverter 630A and the transducer 640A. The pulse width modulation circuit 636A is coupled to the proximity transducers 648A and 649A to change the address of the position sensor 640A by 180° whenever reversing signals are received from the transducer elements 648A and 649A.

Figure 15:
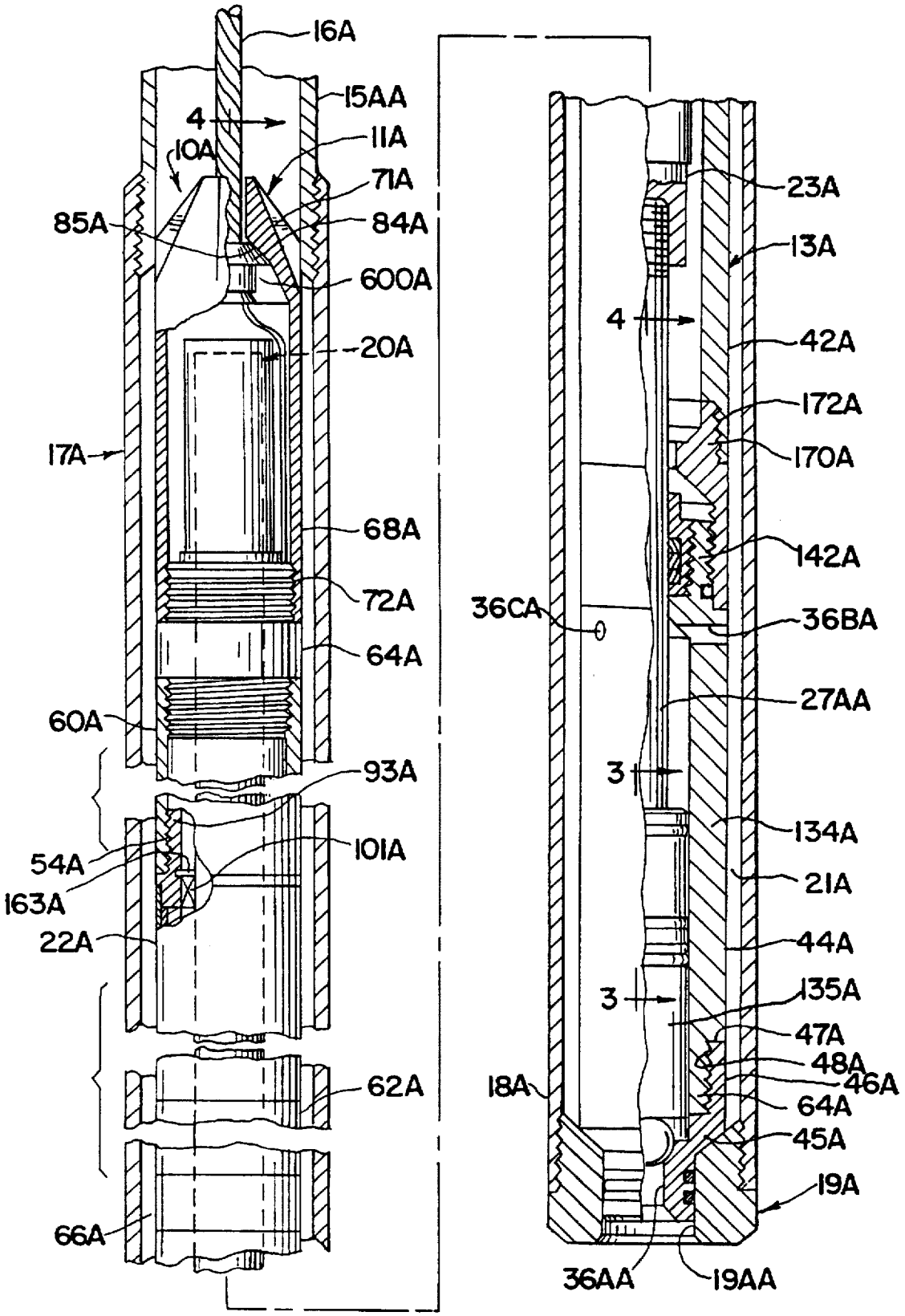
FIG. 15 is a cross section view of the linear d.c. motor mover connecting rod, and the piston pump illustrated in FIG. 14, taken substantially on line 3—3.

Considering now the sucker rod pump 13A in greater detail with reference to FIGS. 13–15, the sucker pump 13A generally comprises a motor assembly engaging portion 42A for helping to couple the motor assembly 11A to the sucker rod pump 13A, a lower seat engaging portion, shown generally at 45A, for engaging the seal seat 19A of the cartridge sleeve assembly 17A in a fluid tight manner, a pump barrel shown generally at 34A, for receiving and pumping the well fluids 12A into the production tubing 15AA as will be explained hereinafter in greater detail and a bell section 170A for sealing well fluids from entering the engaging portion 42A.

The motor assembly engaging portion 42A is generally a hollow elongated cylindrical member having a pair of threaded end portions, such as an end portion 172A. The threaded end portions are adapted to secure together threadably the end bell 66A and the bell section 170A. The interior of the engaging portion 42A has a sufficient large internal diameter to accommodate a containment tube extending downwardly from the end bell 66A.

Considering now the seat portion 45A in greater detail with reference to FIG. 14, the seat portion 45A includes an upward extending annular neck portion 46A terminating in a lip 47A which defines an opening or mouth to the lower seat portion 45A. A set of threads 48A disposed about the inner portion of the neck are adapted to threadably engage the pump barrel 134A.

Considering now the pump barrel 134A in greater detail with reference to FIG. 14, the pump barrel 134A generally includes an upper threaded neck portion 142A for threadably attaching the pump barrel 134A to the motor engaging portion 42A via the bell section 170A and a lower threaded neck portion 64A for threadably attaching the pump barrel 134A to the lower portion 45A. The pump barrel 134A also includes a centrally disposed elongated hollow pump chamber 135A disposed between the upper and lower neck portions 142A and 64A respectively for receiving well fluids 12A. A pump piston 50A is disposed within the pump chamber 135A for causing the pumping of well fluids into and out of the pumping chamber 135A. The chamber portion 35A includes an inlet 36AA and a series of radially extending discharge ports, such as port 36BA and 36CA for passing well fluids through the chamber 135A into a fluid receiving space or channel 21A. It should be understood that the annular space 21A is formed between the cartridge unit 10A and the cartridge sleeve assembly 17A, for permitting the well fluids 12A within the hollow interior of the sleeve assembly 17A to be passed on the outside of the cartridge unit 10A through the pump, and into the production tubing 15AA.

The inlet 36AA is centrally disposed within the bottom lower portion 45A and is in fluid communication with the opening 19AA so that the well fluid 12A, passing through the opening 19AA will flow through the inlet 36AA into the hollow chamber 35A disposed within the pump barrel 134A. The outlet ports, such as port 36BA, permit the well fluids 12A within the pumping chamber 135A to be discharged therefrom into the space 21A.

Considering now the pump piston 50A in greater detail with reference to FIGS. 14 and 15, the pump piston 50A generally includes a hollow cylinder shaped short stubby body 151A connected to a bottom portion 130A of a piston rod connector 27AA for permitting well fluids to pass therethrough. The body 151A includes a centrally disposed internally threaded bore 157A to permit the bottom portion 130A of the piston rod connector 27AA to be threadably connected thereto. The bottom portion 130A when coupled to the body 151A helps define an internal fluid receiving chamber 53A within the interior of the pump piston 50A.

The bottom portion 130A of the piston rod connector 27AA includes an axially extending channel or port 52A that permits fluid within the chamber 53A to pass therethrough and to be discharged by the piston 50A in the chamber 135A. The centrally disposed chamber 53A decreases axially progressively towards an annular inlet portion 58A. The inlet portion 58A permits well fluids within the chamber 135A below the piston 50A to pass therethrough into chamber 53A and thence the channel 52A to be discharged above the piston 50A.

In order to control the flow of well fluids through the piston 50A, a check valve shown generally at 59A is disposed between inlet 58A and chamber 53A. Valve 59A includes a valve member or ball 55A and a tapered valve seat 54A. Check valve 59A allows an upward flow of well fluids into the chamber 53A that prevents down and out flow therefrom. In this regard, as the pump piston 50A travels upwardly it forces the check valve 59A to block inlet 58A so that well fluids above the piston 50A will be discharged from the primary chamber 135A above piston 50A and through the discharge outlets, such as outlet 36BA, into the annular space 21A.

Figure 34:
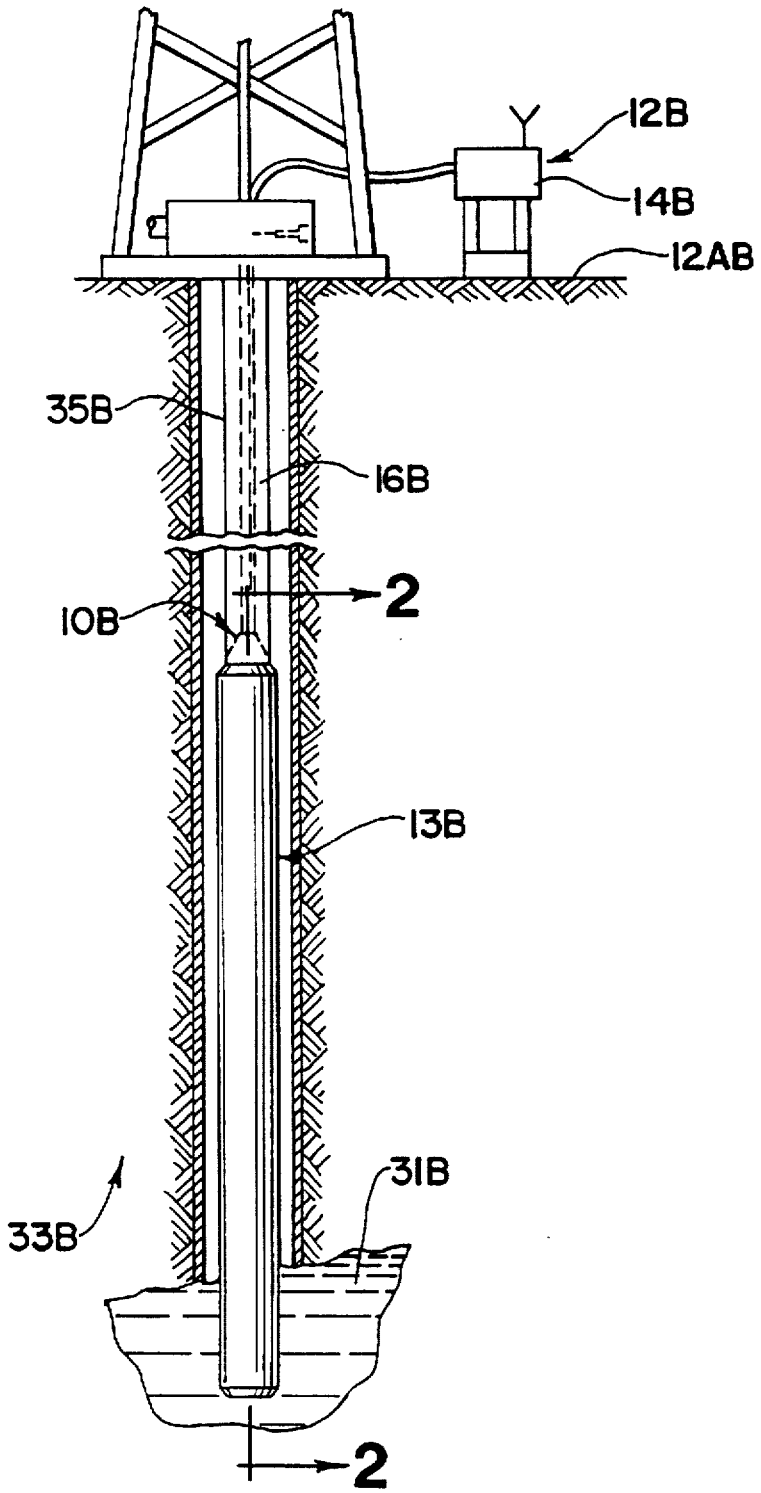
FIG. 34 is a sectional view of a well containing an linear motor-pump assembly which is constructed in accordance with the present invention and which is shown disposed in a sleeve assembly.
Figure 35:
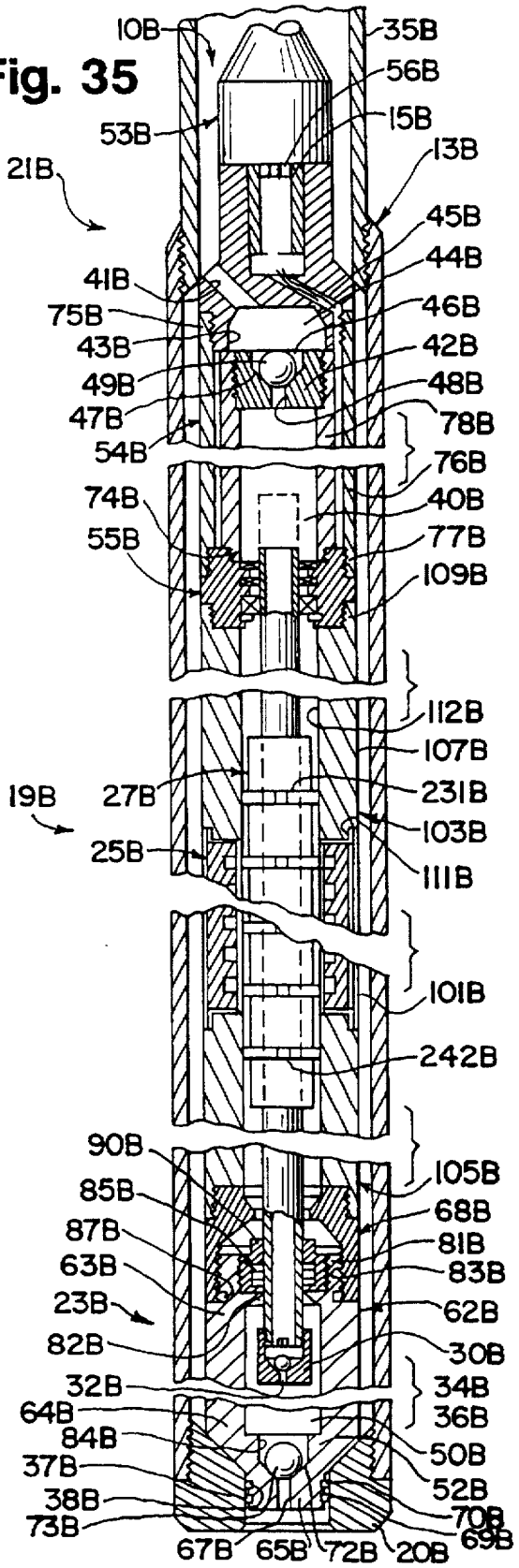
FIG. 35 is a greatly enlarged cross sectional view of the linear motor-pump assembly of FIG. 34.

Referring to to FIGS. 34 and 35 thereof there is shown another linear motor-pump assembly 10B which is constructed in accordance with the present invention and which is adapted for use with a motor controller 12B and sleeve assembly 13B. The sleeve assembly 13B is attached to the terminal end of a production tubing 35B extending downhole in a well 33B and supports from below the motor-pump assembly 10B for fluid pumping purposes. The motor controller 12B controls the operation of the linear motor-pump assembly 10B and includes a surface motor control unit 14B (FIG. 34) and a downhole motor control electronic unit 15B. In the preferred embodiment of the present invention, the downhole motor control electronic unit 15B (FIG. 35) is disposed within the motor-pump assembly 10B and interconnected to the surface motor control unit 14B by a power hoist cable 16B which provides an electrical conduction path for the electrical power supplied to the motor-pump assembly 10B. The motor controller 12B and sleeve assembly 13B are more fully described in U.S. Pat. No. 5,049,046.

Although in the preferred embodiment of the present invention the motor control unit 14B is a pulse type unit which supplies current pulses downhole for energization purposes it will be understood by those skilled in the art that other type and kinds of control arrangements may be employed which do not require the sending of high current pulses down hole. For example, although the motor control electronic unit 15B is shown disposed within the motor-pump assembly 10B, it will be understood by those skilled in the art that such a control unit may be disposed at the surface level or another location spaced apart from the motor pump assembly depending upon the well and its downhole equipment.

Considering now the linear motor-pump assembly 10B in greater detail with reference to FIGS. 34 and 35, the linear motor-pump assembly 10B generally comprises a linear motor shown generally at 19B which is attached threadably between a discharge housing assembly shown generally at 21B adapted to be secured removably to the cable 16B for hoisting purposes and a suction housing assembly shown generally at 23B for facilitating the pumping of well fluids from a down-hole well, such as the well 33B. The linear motor 19B, the discharge housing assembly 21B and the suction housing assembly 23B are secured together removably to form an elongated annularly-shaped cartridge-like assembly that may be hoisted as an integrated unit within a production tubing of a well, such as the tubing 35B.

The linear motor 19B has a modular type construction and includes an elongated annularly-shaped electromagnetic stator assembly 25B coupled electrically to the motor controller 12B and an elongated hollow rod-like mover assembly 27B for interacting electromagnetically with the stator assembly 25B and for providing a fluid conduit to help facilitate the pumping of well fluids, shown generally at 31B, from the well 33B. The mover assembly 27B is mounted telescopically within the stator assembly 25B and moves reciprocatively along a path of travel between a pair of fluid chambers disposed within the discharge housing assembly 21B and the suction housing assembly 23B, respectively. In this regard, whenever the stator assembly 25B is electrically energized by the motor controller 12B the stator 25B coacts electromagnetically with the mover 27B to urge the mover along its path of travel between an elongated fluid discharge chamber 40B disposed within the discharge housing assembly 21B and an elongated fluid suction chamber 50B disposed within the suction housing assembly 23B. The mover assembly 27B is adapted to be attached threadably to a foot check valve shown generally at 30B that travels reciprocatively with the mover 27B and that cooperates with the suction chamber 50B to enable fluids to flow into the suction chamber 50B, thence through the mover assembly 27B into the discharge chamber 40B, and thence to be discharged into the production tubing 35B.

As best seen in FIG. 35, when the motor-pump assembly 10B is seated within the sleeve assembly 13B, the discharge chamber 40B is in fluid communication with the production tubing 35B via a discharge port 41B and a check valve 42B. The stop valve 42B cooperates with the mover assembly 27B for facilitating the discharge of well fluids into the production tubing 35B. In a similar manner, the suction chamber 50B is in fluid communication with the fluids in the well 33B via a suction stop valve 52B that cooperates with the mover assembly 27B for facilitating the receiving of well fluids within the suction housing 23B.

In operation, when the motor-pump assembly 10B is received within the sleeve assembly 13B, a fluid tight seal is formed between the lower portion of the motor-pump assembly 10B and the sleeve 13B. This fluid tight seal prevents well fluids 31B from returning to the reservoir of fluids in the well 33B, so that fluids accumulate within the sleeve assembly 13B and the production tubing 35B to flow upwardly to the surface. Hence, in operation when the stator assembly 25B is energized it coacts electromagnetically with the mover assembly 27B to cause well fluids to flow from the well sump through the suction stop valve 52B, and into the suction pumping chamber 50B, when the mover 27B is disposed at its fluid input position (FIG. 35) on its path of travel.

When the mover 27B moves rectilinearly towards the suction stop valve 52B along its downward path of travel, the fluids within the suction chamber 50B are prevented from flowing back into the sump by the stop valve 52B. In this regard, the downward thrust of force exerted by the mover 27B causes the fluid pressure within the chamber 50B to rise a sufficient amount to permit fluids trapped within the chamber 50B to flow through the foot valve 30B and into the discharge chamber 40B via the mover 27B.

As the mover 27B moves reciprocatively back toward the discharge stop valve 42B the fluids within the discharge chamber 40B are prevented from flowing back into the suction chamber 50B by the foot valve 30B. In this regard, as the mover 27B travels along its path of travel towards the discharge stop valve 42B, the mover 27B causes the fluid pressure within the chamber 40B to rise a sufficient amount above the hydrostatic pressure in the chamber 40B to force fluids trapped within the chamber 40B to flow through the discharge stop valve 42B and into the interior of the sleeve assembly 13B and thence, upwardly into the production tubing 35B. As this process is repeated, the fluid volume in the production tubing 35B increases causing a net flow of fluid outwardly from the production tubing 35B at the surface level.

Considering now the stator assembly 25B in greater detail with reference to FIGS. 35 to 39, the stator assembly 25B generally comprises an annularly-shaped stator 101B and a pair of spaced apart annularly-shaped housing sections 103B and 105B respectively. The stator 101B is disposed between the housing sections 103B and 105B and cooperate with them to define a path of travel for the mover assembly 25B. In the preferred embodiment of the present invention the stator assembly 25B defines a path of travel of about twenty-four inches. This path of travel, however may be increased in order to provide increased thrust for deeper wells. In this regard, the stator assembly and mover assembly are so constructed and arranged that their overall lengths may be increased on a section by section basis as will be explained hereinafter in greater detail.

The housing sections 103B and 105B are coupled threadably to the discharge housing assembly 21B and suction housing assembly 23B respectively to form a cartridge-like unit with a very small transverse to axial ratio. The housing sections 103B and 105B are substantially similar to one another so only housing section 103B will be described in greater detail.

Considering now the housing section 103B in greater detail with reference to FIG. 35, the housing section 103B generally includes a hollow cylindrically shaped central body portion 107B, an integrally connected upper threaded neck portion 109B and an integrally connected lower threaded skirt portion 111B. The threaded skirt portion 111B is adapted to be received threadably within the stator 101B for securing purposes. In a similar manner, the threaded neck portion 109B is adapted to secure threadably the housing section 103B to the discharge housing assembly 21B as will be explained hereinafter in greater detail.

As best seen in FIG. 35, the body portion 107B has an internal bore 112B with a diameter that is dimensioned to engage frictionally a set of spaced apart annularly shaped bearings, such as the bearings 231B–236B forming part of the mover assembly 27B. A similar set of bearings such as bearings 237B–242B are disposed on the opposite end of the mover assembly 27B to engage the inner surface of the housing 105B in a like manner.

Considering now the stator 101B in greater detail with reference to FIGS. 36 to 39 the stator 101B generally comprises an outer annularly-shaped sheath 113B with an inner containment tube 115B mounted telescopically therein by a pair of end caps 117B and 119B. The end caps 117B and 119B are received respectively within opposite ends of the sheath 113B and secured therein by any conventional technique such as adhesive bonding or seal welding. The containment tube 115B has an inner diameter that corresponds to the outer diameter of the mover bearings, such as the bearing 231B so the bearings engaging the inner surface of the tube 115B frictionally and travel therealong as the mover 27B traverses its path of travel.

The stator 101B also includes a centrally disposed core shown generally at 26B (FIG. 36) formed from a set of large circular laminated sections, such as the sections 121B and 123B, and a set of small circular laminated sections 131B and 133B. The laminations are composed of sheets of electrical grade silicone steel or other similar materials and are mounted axially along the outside surface of containment tube 115B. In this regard, in order to align or position the laminated sections, such as sections 121B, 123B, 131B and 133B axially between the sheath 113B and the containment tube 115B a pair of elongated rods (not shown) extend along the entire axial length of the stator 101B. Also, the sheath 113B is under tension to compress the lamination against the containment tube 115B.

Figure 37:
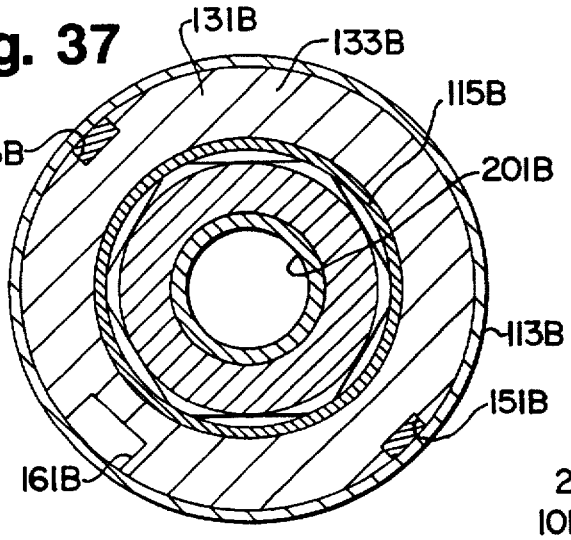
FIG. 37 is a transverse cross sectional view of the mover of FIG. 36 taken substantially along lines 4—4.
Figure 38:
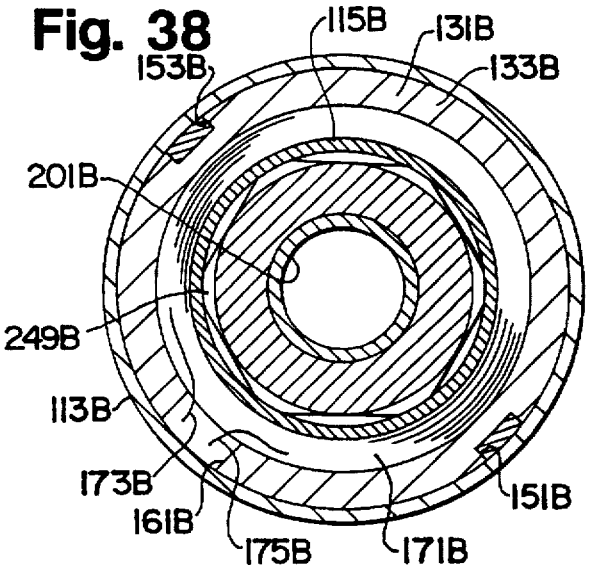
FIG. 38 is a transverse cross sectional view of the stator and mover of FIG. 36 taken substantially along lines 5—5.
Figure 36:
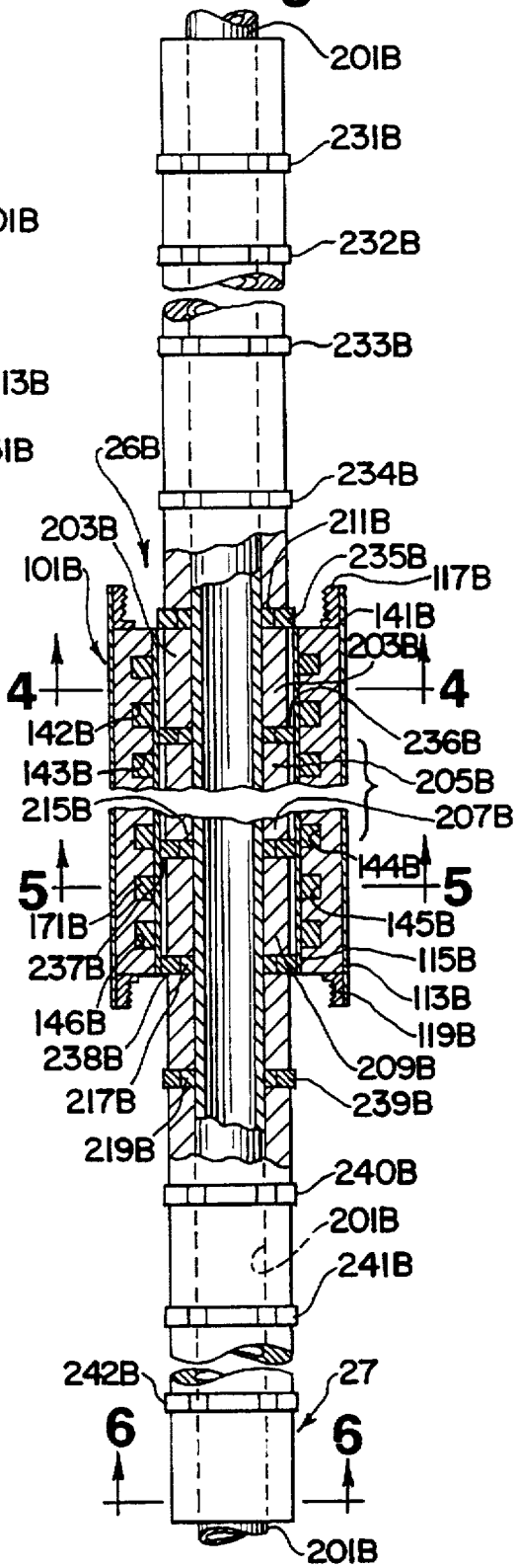
FIG. 36 is an enlarged partial fragmentary view of a mover and stator forming part of the linear motor-pump assembly of FIG. 35.

As best seen in FIG. 36, when the laminated sections, such as 121B and 123B of FIG. 37 or 131B and 133B of FIG. 38, are secured together in groups they define a series of spaced apart coil receiving slots, such as the slots 141B–146B, a pair of oppositely disposed axially extending rod receiving slots 151B and 153B, (FIGS. 37 and 38) and a axially extending cable receiving slot 161B. Each coil receiving slot, such as the slot 145B is dimensioned to receive therein an electromagnetic coil, such as the stator coil 171B.

The stator coils are arranged in interconnected phase groupings and are interconnected by a set of conductors, such as the conductors 173B and 175B disposed within the cable receiving slot 161B. As the phase groupings and electrical interconnections between the coil phase groping are substantially similar to those described in the above mentioned copending patent application no further detailed description will be provided herein.

As best seen in FIG. 35, the inner containment tube 115B protects the lamination sections and stator coils from making direct contact with the mover assembly 27B. In this regard, the containment tube 115B is composed of a non-magnetic material, such as non-magnetic stainless steel, nylon or Teflon, to permit proper electromagnetic reaction between the stator coils and the mover 27B.

From the foregoing it should be understood that for increasing motor thrust, the overall length of the stator assembly 25B may be increased by providing additional laminations and coils and by increasing the length of the sheath, the containment tube, and the assembly rods.

Considering now the mover assembly 27B in greater detail with reference to FIGS. 36 to 39, the mover assembly 27B generally comprises an elongated hollow annular tube like member 201B which has mounted axially thereon (by means not shown) a set of spaced apart permanent magnets, such as the magnets 203B, 205B, 207B and 209B. The magnets 203B–209B are arranged axially with their respective north and south poles alternating along the tube 201B to establish corresponding pole-pairs that coact electromagnetically with the stator coils. The magnets are spaced apart along the tube 201B by a set of substantially nonmagnetic shunting spacers such as spacers 211B, 213B, 215B, 217B and 219B which are also mounted by means not shown, axially along the tube 201B. The arrangement of the magnets and spacers on the tube 201B is similar to actuator 20A and will not be further described.

As best seen in FIGS. 35 and 36 the mover ring bearings 231B–242B to help facilitate the unimpeded rectilinear movement of the mover assembly 27B within the linear motor 19B. In this regard, each ring bearing such as bearing 234B is mounted in overlying relationship with a corresponding spacer, such as the spacer 219B and extends axially outwardly a sufficient distance from the spacer 219B to engage the inner wall of the containment tube 115B. As each of the ring bearings are substantially identical, only ring bearing 242B will be described hereinafter in greater detail.

Figure 39:
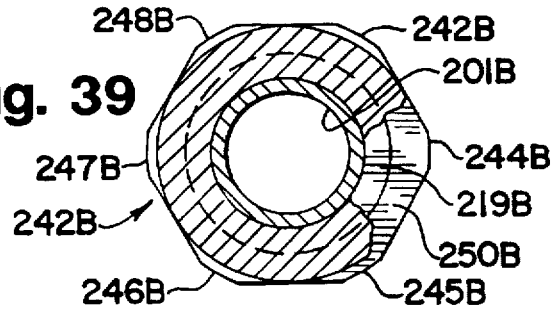
FIG. 39 is a transverse cross sectional view of the mover of FIG. 36 taken substantially along lines 6—6.

Considering now the ring bearing 242B in greater detail with reference to FIGS. 36 and 39, the ring bearing 242B is generally of unitary construction having a general ring shape body member 250B with a set of spoke-like bearing surfaces 243B, 244B, 245B, 246B, 247B and 248B that are equally spaced apart along the outer periphery of the body member 250B. Each of the bearing surfaces, such as bearings 243B and 245B engage the inside wall of the containment tube 115B to help facilitate the movement of the mover 27B therealong and to form a fluid receiving clearance space, such as a clearance space 249B (FIG. 38) therebetween. Such a spacing arrangement between the containment tube wall and the bearing surfaces permit lubricating fluids to be disposed within the clearance space and the housings 103B and 105B for helping to reduce frictional forces and bearing wear.

From the foregoing, it should be understood that for increasing motor thrust, the overall length of the mover assembly 27B may be increased in cooperation with increasing the length of the stator assembly 25B. In this regard, the mover assembly 27B may be increased by providing additional magnets and bearings in proportion to the increased stator length.

Figure 40:
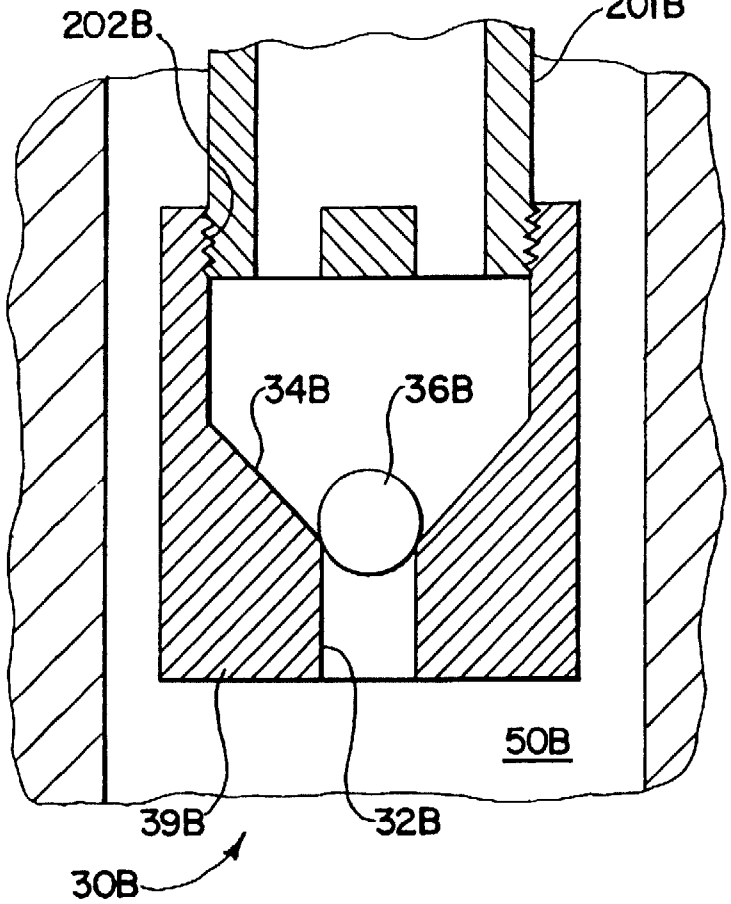
FIG. 40 is a cross sectional view of a stop valve assembly of FIG. 35.

As best seen in FIGS. 35 and 40, the inner tube 201B is sufficiently long to extend into both the discharge chamber 40B and the suction chamber 50B to define a fluid path therebetween via the linear motor 19B. In this regard, in order to control the flow of well fluids through the tube 201B, a lower end portion 202B (FIG. 40) of the tube 201B is adapted to receive threadably thereon the check valve 30B. This arrangement permits the check valve 30B to travel reciprocatively within the chamber 50B.

Considering now the stop valve 30B in greater detail with reference to FIG. 40, the stop valve 30B includes a body member 39B with a centrally disposed inlet 32B defining a fluid path between the interior of the tube 201B and the interior of the chamber 50B. For the purpose of controlling the flow of fluid within the tube 201B, the stop valve 30B also includes a tapered valve shoulder or seat 34B that is adapted to support a ball-like valve member 36B in the inlet 32B. In this regard, the member 36B allows the flow of fluid upwardly into the tube 201B as the mover assembly 27B is moving rectilinearly downwardly, but blocks the down and out flow of fluids out through the inlet 32B as the mover assembly 27B is moving rectilinearly upwardly.

Considering now the suction housing assembly 23B in greater detail with reference to FIG. 35, the suction housing assembly 23B generally includes a sleeve engaging section 62B for receiving sump well fluids and for engaging sealingly the sleeve assembly 13B and an end bell section 68B which is secured threadably removably between the linear motor 19B and the suction chamber section 62B for providing a high pressure seal therebetween.

The sleeve engaging section 62B generally includes a hollow annular-shape barrel portion shown generally at 63B for coupling to the end bell 68B and an integrally formed generally conically shaped seat engaging portion 64B that cooperates with the barrel portion 63B to define the suction chamber 50B. The suction chamber 50B is adapted to be in fluid communication with the sump fluids when the motor-pump assembly 10B is disposed downhole within the sleeve assembly 13B. In this regard, the conically shaped seat engaging portion 64B includes a generally cylindrically shaped end portion 65B having a centrally disposed inlet 67B. The end portion 65B is adapted to be received within a seat 20A forming part of the sleeve assembly 13A. The end portion 65A includes a pair of spaced apart annular grooves 69A and 70A which are dimensioned to receive a metallic quad seal 37A and a neoprene wiper seal 38A respectively. The seals 37A and 38A form a fluid tight seal between the end portion 65A and the seat 20A. In this regard, the seals 37A and 38A prevent fluids discharged within the sleeve assembly 13A and the production tubing 35A from returning to the well sump via the inlet within the seat 20A.

As best seen in FIG. 35, the inlet 67B has a generally annular shape and extends upwardly axially. The upper portion of the inlet 67B diverges radially outwardly to define a conically shaped shoulder 72B or seat that is adapted to support a ball-like valve member 73B in the inlet 67B. In this regard, when the mover travels upwardly toward the stop valve 42B, the valve member 73B is pulled upwardly by suction allowing fluids to enter into the chamber 30B. Contrawise, when the mover travels downwardly toward the seat 20B, the valve member 73B blocks inlet 67B preventing the fluids in chamber 50B from returning to the well sump.

Considering now the suction chamber 50B in greater detail with reference to FIG. 35, the suction chamber 50B is generally cylindrically shaped having a centrally disposed upper opening 82B that is dimensioned to receive the lower end of the tube 201B therein and a centrally disposed lower opening or inlet 84B that is co-axially aligned with the opening 67B for permitting well fluids to pass into the chamber 50B. The lower end of the suction chamber 50B terminates in the suction stop valve 52B that allows an upflow of well fluids into the suction chamber 50B but prevents down and outflow therefrom.

Considering now the barrel portion 63B in greater detail with reference to FIG. 35, the barrel portion 63B includes an upper annular threaded neck portion 81B defining an opening to the suction chamber 50B. The neck portion 81B has a set of external threads 83B adapted to secure threadably the sleeve engaging section 62B to the end bell assembly 68B.

As best seen in FIG. 35, a barrel gasket seal 87B is disposed on the exterior of the lower portion of the neck 81B that cooperates with the end bell assembly 68B to form a fluid tight seal between the gasket 87B and the end bell 68B when they are engaged threadably together.

The upper neck portion 81B also includes a hollowed out centrally disposed cylindrically-shaped recess portion having a set of threads 85B which are adapted to threadably receive and secure within the recess a high pressure sealing plug 90B between the linear motor 19B and the suction chamber 50B. The centrally disposed opening 82B in the top of the chamber 50B extends into the base of the recess enabling the chamber 50B to be sealed by the plug 90B. The opening 82B is dimensioned to receive therein the inner tube 201B.

Considering now the high pressure sealing plug 90B in greater detail with reference to FIG. 35, the plug 90B includes a centrally disposed opening or bore which is aligned co-axially with and similarly dimensioned to the opening 82B in order to enable the tube 201B to pass freely therethrough. The exterior of the plug 90B is threaded for threadably engaging the threads 85B. In order to prevent the leakage of the lubricating fluids within the linear motor 19B into the suction chamber 50B and in order to prevent the contaminate leakage of the well fluids into the stator 101B, the sealing plug 90B includes an annularly shaped metallic quad high pressure seal and a spaced apart annularly shaped neoprene wiper seal. The high pressure seal and the wiper seal are spaced apart by a centrally disposed annularly-shaped metallic spacer. The seals as well as the spacer each include centrally disposed openings that are dimensioned to frictionally engage the tube 201B for fluid sealing purposes.

Considering now the discharge housing assembly 21B in greater detail with reference to FIG. 35, the discharge housing assembly 21B generally includes a cable housing 53B for coupling the control electronic unit 15B to the hoisting cable 16B, a discharge head 54B, for helping to control the flow of fluid out to the production tube 35B, and a discharge bell 55B for sealing the discharge chamber 40B from the linear motor 19B. The cable housing 53B, discharge head 54B, and discharge bell 55B are secured removably together.

Considering now the cable housing 53B in greater detail with reference to FIG. 35, the cable housing 53B is adapted to be coupled to the cable 16B and includes a centrally disposed chamber 56B that is dimensioned for receiving therein the electronic control unit 15B.

The lower portion of the housing 53B defines a threaded neck portion 43B having a cup-shaped recess 44B disposed therein. The recess 44B is in fluid communication with the production tube 35B via the discharge port 41B. The threaded neck portion 43B is adapted to secure threadably the cable housing 53B to the discharge head 54B. The cable housing 53B also includes a conductor channel 45B for receiving the control lines coupled between the control unit 15B and each stator coils, such as coil 171B.

Considering now the discharge head 54B in greater detail, the discharge head 54B generally comprises an upper threaded neck portion 75B adapted to engage threadably the cable housing 53B and a lower threaded neck portion 77B adapted to engage threadably the bell housing 55B. An integrally formed barrel section 76B is disposed between the neck portions 75B and 76B for helping to define the discharge chamber 40B.

For the purpose of controlling the flow of fluids through the discharge chamber 40B, the barrel section 76B includes a cylindrically-shaped elongated sleeve 78B with a lower threaded skirt portion 74B adapted to couple the sleeve 78B threadably into the bell assembly 55B. The upper end portion of the sleeve 78B is threaded internally and is dimensioned for receiving therein the stop valve 42B. The sleeve 78B defines a path of travel for the upper portion of the tube 201B forming part of the mover assembly 27B.

Considering now the stop valve 42B in greater detail with reference to FIG. 35, the stop valve 42B is cylindrically shaped body member with an external thread adapted to permit the stop valve 42B to be received threadably in the sleeve 78B. The stop valve 42B includes a centrally disposed opening 46B that is in fluid communication with the discharge port 41B. The opening 46B extends downwardly terminating in a tapered shoulder 47B. The shoulder 47B converges into a centrally disposed inlet 48B that is in fluid communication with the discharge chamber 40B. A ball-like valve member 49B is supported by the shoulder 47B for blocking the inlet 48B. In this regard, when the mover 27B travels upwardly toward the stop valve 42B it produces a sufficient amount of force to lift the valve member 49B and thus, opening the inlet 48B to permit fluids to pass from chamber 40B into the production tubing 35B. When the mover 27B travels downwardly away from the valve 42B, the valve member 49B falls under the force of gravity to once again block inlet 48B thus, preventing fluids in the production tube 35B from returning to the discharge chamber 40B.

Considering now the bell assembly 55B in greater detail with reference to FIG. 35, the bell assembly 55B seals the discharge chamber 40B from the linear motor 19B. In this regard, the bell assembly 55B includes a centrally disposed opening 56B that is dimensioned for permitting the tube 201B to pass therethrough. A set of seals are disposed in the bell assembly 55. In this regard, as the discharge bell assembly 55B is substantially similar to the bell assembly described with reference to assembly 10A and will not be described herein in greater detail.

Figure 41:
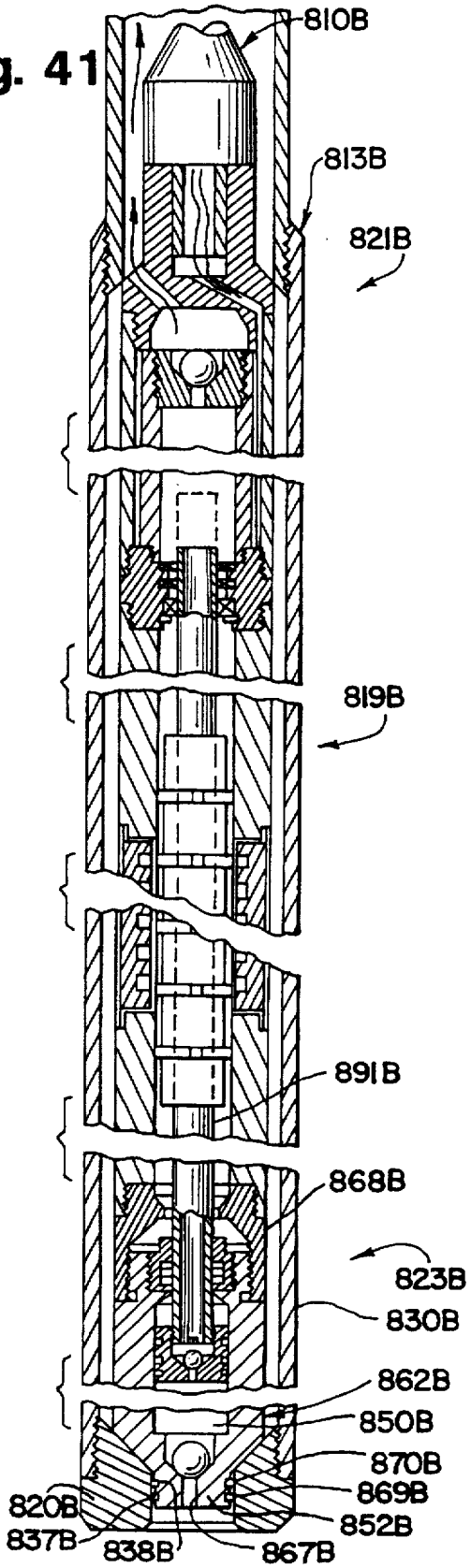
FIG. 41 is a greatly enlarged cross sectional view of another linear motor-pump assembly which is constructed in accordance with the present invention and which is shown disposed in a sleeve assembly.
Figure 42:
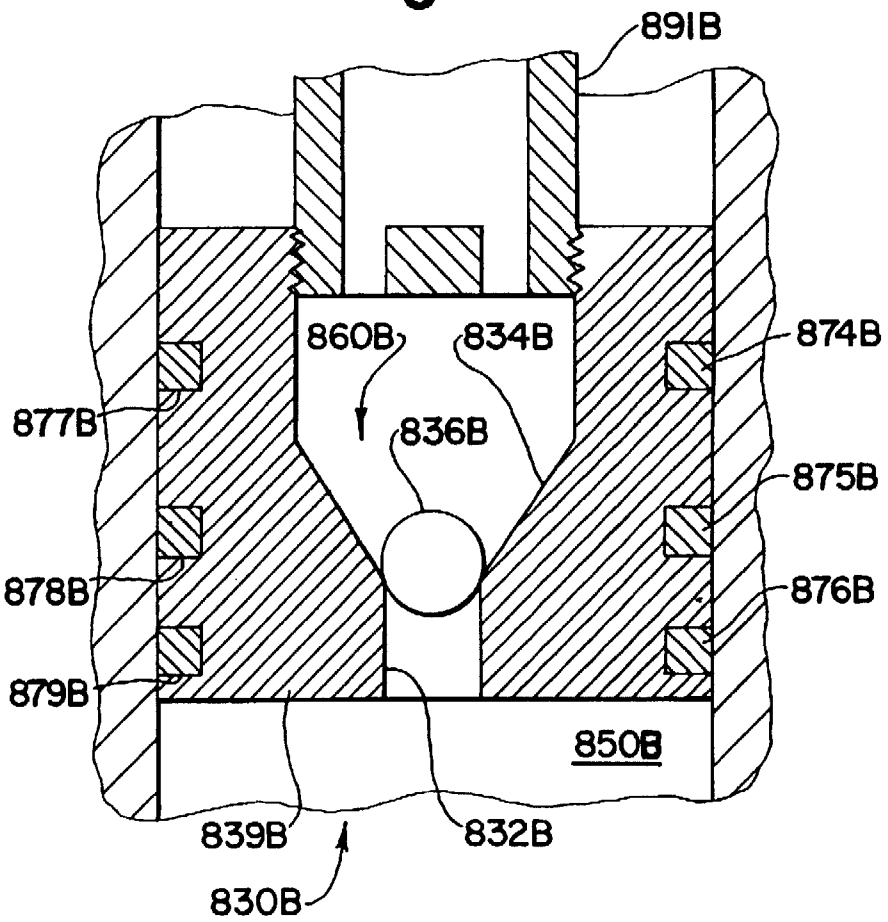
FIG. 42 is a cross sectional view of a piston assembly of FIG. 44.

Referring now to FIGS. 41 and 42 there is shown another linear motor assembly 810B which is also constructed in accordance with the present invention. The motor-pump assembly 810B includes a linear motor 819B disposed between a piston pump assembly 823B and a discharge assembly 821B. As the linear motor 819B and discharge assembly 821B are substantially similar to assemblies 19B and 21B they will not be described.

Considering now the piston pump assembly 823B in greater detail with reference to FIGS. 41 and 42, the piston pump assembly 823B is adapted to be threadably attached to the linear motor 19B and generally includes a seat engagement section 862B and a bell housing assembly 868B. The seat engagement section 862B is adapted to be received removably sealingly within the sleeve assembly 813B that is substantially the same as the sleeve assembly 13B. In this regard the seat engagement section 860B includes a pair of spaced apart annular grooves 869B and 870B which are dimensioned to receive a metallic quad seal 837B and a neoprene wiper seal 838B respectively. The seals 837B and 838B form a fluid tight seal between the seat engagement section 860B, 862B and a seat 80B forming part of the sleeve assembly 813B to prevent fluids discharged within the sleeve assembly and the production tubing of the well from returning to the well sump. As best seen in FIG. 40, the seat engagement section includes a centrally disposed inlet 867B that permits well fluids to enter a suction chamber 850B defined by the barrel of the seat engagement section 862B.

Considering now the suction chamber 850B in greater detail with reference to FIG. 42, the suction chamber 850B is generally cylindrically shaped having a centrally disposed upper opening that is dimensioned to receive and support a hollow tube member 891B forming part of the linear motor 819B. The diameter of the suction chamber 850B is dimensioned to accommodate therewithin a piston assembly 830B which is adapted to be attached threadably to the lower terminal end portion of member 898B is threaded to permit the piston assembly 830B to be attached threadably thereto.

As best seen in FIGS. 41 and 42, the piston assembly 830B is sealed dynamically to the inner walls of the suction chamber 850B to create a vacuum in that portion of chamber disposed below the piston assembly 830B.

Considering now the piston assembly 830B in greater detail with reference to FIG. 41 and 42, the piston assembly 830B generally includes a body or piston member 839B for engaging the inner walls of the suction chamber 850B to create a vacuum pressure within the chamber 850B and stop valve 860B for controlling the flow of fluid through the body member 839B.

As best seen in FIG. 42, the body member 839B includes a centrally disposed inlet 832B defining a fluid path between the interior of the tube 891B and the interior of the chamber 950B. For the purpose of controlling the flow of fluid within the tube 891B, the stop valve 860B includes a tapered valve shoulder 834B that is integrally formed with the body member 839B. The shoulder 834B is adapted to support a bell-like valve member 836B that also forms part of the stop valve 860B. The valve member 836B allows fluid flow upward into the tube 891B but prevents down and out flow from the tube 891B as the tube 891B moves upwardly away from the seat 820B.

A set of spaced apart seals, such as seals 874B–876B are disposed in a set of grooves 877B–879B respectively disposed in the body member 839B. In this regard, the seals 874B–876B establish a fluid tight seal between the upper and lower portions of the chamber 850B. In this regard, as the tube 891B moves downwardly fluids disposed within chamber 850B below the body member 839B are forced under pressure upwardly through the body member 839B and into the tube 891B thence into the discharge housing assembly 821B for discharge into the production tubing of a well.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A tubular linear motor construction for use in an elongated hollow ferromagnetic well tubing having an annular transverse cross-sectional area $A_T$, comprising:

elongated stator core means adapted to be raised and lowered within the well tubing for helping to define a magnetic flux path including an outer flux path portion in the well tubing, said stator core means including tooth means of a stator tooth area $A_S$ for defining intermediate flux path portions of said magnetic flux path and having coil means disposed thereon within slots between said tooth means for carrying multi-phased electrical current and means defining a large area air gap for facilitating the production of an axial force of a given magnitude;

said coil means being disposed adjacent to the well tubing when received therein to facilitate heat dissipation from said coil means and to enable said air gap means to define said large area air gap;

elongated mover core means adapted to be received within said air gap and having a transverse mover area $A_M$ for defining an inner flux path portion of said magnetic flux path, said mover core means including flux means for producing magnetic flux in said magnetic flux path for interacting electromagnetically with the multi-phased current to facilitate the production of said axial force of a given magnitude;

wherein the ratio of the stator tooth area $A_S$ to the transverse tube area $A_T$ of the hollow well tubing is equal to between about 0.1 and about 1.25 for enabling the thickness of said tooth means to be reduced without restricting said magnetic flux; and wherein the ratio of the stator tooth area $A_S$ to the mover area $A_M$ is equal to between about 0.1 and about 1.25, to provide sufficient magnetic flux linkage between the well tubing, said stator core means and said mover core means to develop high thrust for the motor for a relatively short motor size, with reduced heat loss.

2. A tubular linear motor construction according to claim 1, wherein said outer flux path portion has an annular cross-sectional area $A_{FT}$ which is a portion of the area $A_T$.

3. A tubular linear motor according to claim 2 wherein said flux means is a plurality of spaced apart pairs of oppositely poled permanent magnets and wherein said elongated mover core means includes an elongated mover core for mounting said plurality of spaced apart pairs of oppositely poled permanent magnets thereon, said mover core having an annularly cross-sectional area defined by $A_M$; and wherein said elongated stator core means includes an elongated stator core for mounting said plurality of spaced apart electrical coils thereon, said stator core having an annular cross-sectional area defined by $A_S$.

4. A tubular linear motor according to claim 2, wherein a more preferred value of the ratio of $A_S$ to $A_T$; is between about 0.75 and 1.0.

5. A tubular linear motor according to claim 4, wherein the most preferred value of the ratio of $A_S$ to $A_T$ is about 1.0.

6. A tubular linear motor according to claim 1, wherein said ratio of $A_S$ to $A_M$ is between about 0.75 and about 1.0.

7. A tubular linear motor according to claim 6, wherein the preferred ratio of $A_S$ to $A_M$ about 1.00.

8. A tubular linear motor according to claim 1, wherein said flux means includes radial permanent magnets.

9. A tubular linear motor according to claim 1 wherein said flux means is axially magnetized permanent magnet means, including a plurality of pairs of oppositely poled, spaced apart, annularly-shaped, permanent magnets.

10. A tubular linear motor according to claim 1 wherein mover core means includes a plurality of spaced apart annularly-shaped bearings each having a smoothly rounded outer surface for engaging the inner surface of said stator means.

11. A tubular linear motor according to claim 10 wherein said coil means is three single electrical conductors including a first phase conductor for carrying a first phase electrical current, a second phase conductor for carrying second phase electrical current, and a third phase conductor for carrying third phase electrical current, and wherein said mover core means is hollow throughout its axial length for passing pumped fluids therethrough.

12. A tubular linear motor according to claim 10 wherein said stator includes a plurality of spaced apart annularly-shaped iron rings, each one of said plurality of annularly-shaped iron rings having a unitary construction and including an annular-shaped base member having an outside diameter and an inside diameter and a conical-shaped tooth member having an outside diameter and an inside diameter, said tooth member extending upwardly from said base member and terminating in a lip defining a common opening between said base member and said tooth member.

13. A tubular linear motor according to claim 12 wherein the outside diameter of said tooth member is substantially less than the outside diameter of said base member.

14. A tubular linear motor according to claim 13 wherein each individual one of said plurality of annularly-shaped iron rings include an open slot, said slot extending radially inwardly from the outside periphery of said base member and terminating at about the outside periphery of said tooth member.

15. A tubular linear motor according to claim 14 wherein individual ones of the tooth members are spaced apart from one another for defining the coil receiving slots, said slots including a set of first phase coil receiving slots, a set of second phase coil receiving slots, and a set of third phase coil receiving slots.

16. A tubular linear motor according to claim 15 wherein said first phase conductor is received within said first phase and receiving slots, said second phase conductor is received within said second phase coil receiving slots, and said third phase conductor is received within said third phase coil receiving slots.

17. A method of using a tubular linear motor construction according to claim 1, comprising:

disposing said stator means within the well tubing;

disposing said mover core means within said air gap;

electromagnetically coupling said elongated stator means and said mover core means;

moving said mover means relative to said elongated stator means, and pumping fluids from the downhole well tubing.

18. A tubular linear motor construction for use with a hollow ferromagnetic well tube having a wall thickness $T_T$, comprising:

a hollow thick-walled mover for defining a fluid carrying passageway, said mover having a wall thickness $T_M$;

a hollow stator having a sufficiently small diameter to be received within the well tube for cooperating with the well tube and said mover to define a flux path therethrough, said stator further having a sufficiently large longitudinal passageway to receive said mover therein for free relative movement;

means defining a large air gap between said mover and said stator when said mover is surrounded by said stator, said large air gap having a diameter D and an axial length L;

a plurality of pairs of annularly-shaped spaced apart oppositely poled flux means disposed within said air gap for passing a plurality of fields of magnetic flux through said flux path;

said stator having a plurality of teeth members defining a series of annularly-shaped coil receiving slots along the axial length L;

phase A coil winding means mounted continuously within selected axially spaced apart ones of said slots and being integrally connected together;

phase B coil winding means mounted continuously between other selected ones of said plurality of spaced apart stator teeth;

wherein said teeth members are adapted to position said phase A coil winding means and said phase B coil winding means adjacent to the well tube for facilitating heat dissipation, and are further adapted to enable said air gap means to define said large air gap;

means for connecting electrically one set of ends of said winding means to form a common node; and means at the other ends of said winding means for coupling electrically to a multiple phase power source.

19. A method of constructing a tubular linear motor construction for downhole use with ferromagnetic well tubing, comprising:

using a plurality of annularly-shaped iron rings to help define a magnetic flux path in cooperation with the well tubing, each individual ring including an annular base member having a top and bottom surface to define intermediate flux path portions of said magnetic flux path, conically shaped tooth member integrally connected to the top surface of said base member and extending upwardly therefrom terminating in a centrally disposed lip defining a common opening extending axially throughout the entire length of said iron ring;

mounting a plurality of said iron rings removably onto an elongated hollow mandrel having a stop on one end thereof to help define a stator unit, said stop having a diameter substantially greater than said common opening, adjacent ones of said plurality of iron rings defining a plurality of coil receiving spaces, each space being defined as the distance from the top surface of said base member to the lip of the integrally connected tooth member;

said plurality of coil receiving spaces including a set of spaced apart first phase coil receiving slots, a set of spaced apart second phase coil receiving slots, and a set of spaced apart third phase coil receiving slots;

wrapping a single first phase conductor for carrying electrical current about every tooth disposed in said set of spaced apart first phase coil receiving slots to form a plurality of first phase electrical coils, said first phase coils being wrapped continuously from tooth member to tooth member alternately in clockwise and counter-clockwise directions;

wrapping a single second phase conductor for carrying electrical current about every tooth disposed in said set of spaced apart second phase coil receiving slots to form a plurality of second phase electrical coils, said second phase coils being wrapped continuously from tooth member to tooth member alternately in clockwise and counter-clockwise directions;

wrapping a single third phase conductor for carrying electrical current about every tooth disposed in said set of spaced apart third phase coil receiving slots to form a plurality of third phase electrical coils, said third phase coils being wrapped continuously from tooth member to tooth member alternately in clockwise and counter-clockwise directions;

adapting said base members to permit said stator unit to be received within the well tubing, wherein said first phase conductor, said second phase conductor and said third phase conductor will be substantially enclosed by the well tubing, adjacent base members of adjacent iron rings, and said tooth member;

said adjacent base members defining intermediate portions of said magnetic flux path for cooperating with the well tubing when received therein, said well tubing defining an outer portion of said magnetic path;

electrically connecting one end of each of the single first phase, second phase and third phase conductors together to form a common node therebetween, and exposing the opposite ends of each of the single first phase, second phase and third phase conductors for attachment to different phases of electrical current, and mounting elongated hollow mover means within said stator unit for free relative movement to produce magnetic flux within said magnetic flux path, and said mover means defining an interior portion of said magnetic flux path.

20. A method according to claim 19 further comprising:

mounting said stator unit within the hollow interior of the ferromagnetic well tube.

21. A method of using a tubular linear motor construction in cooperation with a downhole ferromagnetic well tube to transport well fluid, comprising:

using a stator including a plurality of annular tooth members coupled to one another to define an axial opening therethrough and a plurality of annual coil slots between adjacent ones of said tooth members to receive current carrying coils therein, and a mover adapted to be received within said axial opening and including a plurality of magnets disposed on a mover core having a fluid passageway therethrough;

disposing said stator within the well tube to position said coils adjacent to the well tube, wherein said coils are surrounded by the well tube and adjacent ones of said tooth members;

disposing said mover within said axial opening to help define a magnetic flux path for flux produced by said magnets through the well tube, said adjacent ones of said tooth members and said mover core;

conducting electrical current through said coils for electromagnetically coupling said stator and said mover to produce an axial electromagnetic force for facilitating the transportation of the well fluid through the fluid passageway; and dissipating excess heat generated by the electrical current through the well tube.

22. A method according to claim 21, further comprising conducting a three phase electrical current through said coils.

23. A method according to claim 22, further comprising coupling the motor construction to a pump for pumping well fluids.

* * * * *